US007811182B2

(12) United States Patent
Ligotti, III et al.

(10) Patent No.: US 7,811,182 B2
(45) **Date of Patent: *Oct. 12, 2010**

(54) METHOD FOR PREDICTING A GOLFER'S BALL STRIKING PERFORMANCE

(75) Inventors: Peter Ligotti, III, Encinitas, CA (US); Scott R. Manwaring, Carlsbad, CA (US); Frank H. Fan, Melrose, MA (US)

(73) Assignee: Callaway Golf Company, Carlsbad, CA (US)

( * ) Notice: Subject to any disclaimer, the term of this patent is extended or adjusted under 35 U.S.C. 154(b) by 748 days.

This patent is subject to a terminal disclaimer.

(21) Appl. No.: 11/762,292

(22) Filed: Jun. 13, 2007

(65) Prior Publication Data

US 2007/0244667 A1 Oct. 18, 2007

Related U.S. Application Data

(63) Continuation-in-part of application No. 10/843,783, filed on May 11, 2004, now abandoned.

(51) Int. Cl.
*A63B 57/00* (2006.01)

(52) U.S. Cl. ..... 473/407; 273/317.2; 348/207.1

(58) Field of Classification Search ..... 273/317.2; 382/106, 107; 348/61, 143, 207.99, 207.1, 348/207.11, 552; 473/406, 407, 223, 226, 473/199, 200

See application file for complete search history.

(56) References Cited

U.S. PATENT DOCUMENTS 4,063,259 A 12/1977 Lynch et al.
4,136,387 A 1/1979 Sullivan et al.
4,375,887 A 3/1983 Lynch et al.
5,501,463 A 3/1996 Gobush et al.
5,697,791 A 12/1997 Nashner et al.
5,779,241 A 7/1998 D'Costa et al.
5,803,823 A 9/1998 Gobush et al.
6,186,002 B1 2/2001 Lieberman et al.
6,506,124 B1 1/2003 Manwaring et al.
6,602,144 B2 8/2003 Manwaring et al.
6,821,209 B2 11/2004 Manwaring et al.
6,929,558 B2 8/2005 Manwaring et al.

*Primary Examiner*—Dmitry Suhol
*Assistant Examiner*—Robert Mosser
(74) *Attorney, Agent, or Firm*—Michael A. Catania; Elaine H. Lo

(57) ABSTRACT

A method for a predicting golfer's performance is disclosed herein. The method inputs the pre-impact swing properties of a golfer obtained from a CMOS imaging system, a plurality of mass properties of a first golf club, and a plurality of mass properties of a first golf ball into a rigid body code. Ball launch parameters are generated from the rigid body. The ball launch parameters, a plurality of atmospheric conditions and lift and drag properties of the golf ball are inputted into a trajectory code. This trajectory code is used to predict the performance of a golf ball if struck by the golfer with the golf club under the atmospheric conditions. The method can then predict the performance of the golf ball if struck by the golfer with a different golf club. The method and system of the present invention predict the performance of the golf ball without the golfer actually striking the golf ball.

18 Claims, 34 Drawing Sheets

| Point | World X | World Y | World Z | Error |
|---|---|---|---|---|
| 1 | 29.450 | -103.307 | -233.802 | 1.038 |
| 2 | 30.831 | -85.566 | -265.861 | 1.256 |
| 3 | -6.378 | -103.560 | -234.665 | 1.051 |
| 4 | -6.133 | -85.495 | -266.727 | 1.239 |
| 5 | -42.418 | -104.266 | -234.779 | 1.099 |
| 6 | -43.248 | -86.050 | -266.888 | 1.226 |
| 7 | 46.192 | 14.770 | -290.289 | 0.201 |
| 8 | 5.158 | 15.938 | -291.271 | 0.005 |
| 9 | -35.937 | 16.234 | -291.519 | 0.121 |

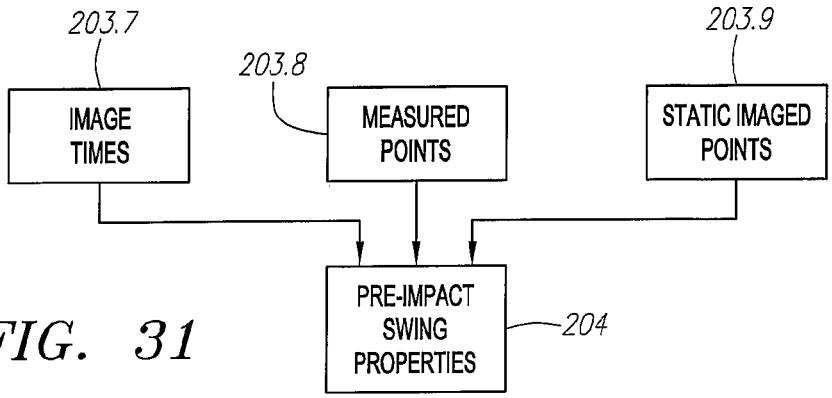
FIG. 31
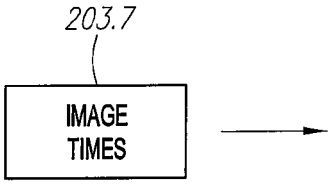
| | GOLFER A | GOLFER B | |
|---|---|---|---|
| 1 | 100 | 100 | USECS |
| 2 | 474.64 | 445.24 | |
| 3 | 849.28 | 790.48 | |
| 4 | 1223.92 | 1135.72 | |
| 5 | 1598.56 | 1480.96 | |
| 6 | 1973.2 | 1826.2 | |
FIG. 32
203.8 MEASURED POINTS
| | GOLFER A | | | | GOLFER B | | |
|---|---|---|---|---|---|---|---|
| POINT | x | y | z | | x | y | z |
| 1 | 22.5248 | -83.9985 | -277.294 | mm | 19.041 | -72.461 | -259.712 |
| 2 | 24.169 | -65.4006 | -303.476 | | 22.4965 | -55.2863 | -286.794 |
| 3 | 7.19187 | -82.9872 | -277.522 | | 4.01986 | -70.4449 | -259.675 |
| 4 | 8.42472 | -64.3227 | -303.821 | | 7.01569 | -53.2288 | -286.847 |
| 5 | -8.13186 | -82.1665 | -277.659 | | -10.9967 | -69.261 | -259.648 |
| 6 | -7.22265 | -63.5248 | -303.832 | | -8.4661 | -51.7105 | -286.751 |
| 7 | -23.3764 | -81.5513 | -277.808 | | -26.1186 | -68.0642 | -259.411 |
| 8 | -23.0235 | -62.4671 | -303.799 | | -24.0434 | -50.5302 | -286.55 |
| 9 | -38.7101 | -81.1989 | -277.632 | | -41.2492 | -66.9375 | -259.08 |
| 10 | -38.7728 | -62.1541 | -303.773 | | -39.6559 | -49.2957 | -286.093 |
| 11 | -53.8825 | -80.338 | -277.333 | | -56.2913 | -65.3794 | -258.417 |
| 12 | -54.3404 | -61.5229 | -303.473 | | -55.2933 | -48.2721 | -285.617 |
| 13 | 55.757 | 37.5722 | -317.082 | | 52.9912 | 47.9439 | -304.485 |
| 14 | 38.0195 | 39.5086 | -317.184 | | 35.5873 | 50.1247 | -304.708 |
| 15 | 20.3043 | 41.514 | -317.408 | | 18.3605 | 52.5852 | -304.554 |
| 16 | 2.59074 | 42.9978 | -317.464 | | 0.955063 | 54.6563 | -304.407 |
| 17 | -15.4104 | 43.8896 | -317.378 | | -16.5273 | 56.2923 | -303.924 |
| 18 | -33.2143 | 45.1303 | -316.736 | | -33.9984 | 57.8887 | -303.17 |
| 19(BALL) | -133.559 | -3.897 | -315.635 | | -133.559 | -3.897 | -315.635 |
FIG. 33

203.9

STATIC IMAGE POINTS

| | GOLFER A | | | | GOLFER B | | |
|---|---|---|---|---|---|---|---|
| POINT | x | y | z | | x | y | z |
| 1 | -86.2027 | -59.7842 | -288.178 | mm | -86.2027 | -59.7842 | -288.178 |
| 2 | -73.7585 | -51.7931 | -317.232 | | -73.7585 | -51.7931 | -317.232 |
| 3 | 16.84 | 7.93595 | -341.742 | | 16.84 | 7.93595 | -341.742 |
| 4 | -26.4742 | 4.66858 | -370.935 | | -26.4742 | 4.66858 | -370.935 |
| 5 | -19.7858 | 3.87145 | -343.333 | | -19.7858 | 3.87145 | -343.333 |
| 6 | -64.4634 | -31.0241 | -339.31 | | -64.4634 | -31.0241 | -339.31 |
| 7 | -66.9001 | -27.2861 | -367.303 | | -66.9001 | -27.2861 | -367.303 |
| 8 | -44.8512 | -9.84895 | -353.971 | | -44.8512 | -9.84895 | -353.971 |

*FIG. 34*

202

CLUB HEAD PROPERTIES

| | | | | |
|---|---|---|---|---|
| 401 | FACE PROPERTIES | STEEL | Ti | |
| | FACEANGLE | 0 | 0 | DEGREE |
| | FACEBOTTOMCENTER | | | |
| | x | -0.714 | -0.795 | INCH |
| | y | 0.756 | 0.643 | |
| | z | 0.17 | 0.197 | |
| | FACECENTER | | | |
| | x | 0 | 0 | |
| | y | 0.756 | 0.643 | |
| | z | 0.949 | 1.21 | |
| | BULGE | 9.5 | 11 | INCH |
| | ROLL | 11 | 11 | |
| 402 | MASS PROPERTIES | | | |
| | MASS | 197 | 187 | GRAM |
| | CGX | 0.423 | 0.634 | INCH |
| | CGY | 0.664 | 0.574 | |
| | CGZ | 0.871 | 0.9899 | |
| | MOIxx | 1737 | 2291 | GRAMCM2 |
| | MOIyy | 1378 | 1781 | |
| | MOIzz | 2337 | 2871 | |
| | MOIxy | 213 | 247 | |
| | MOIxz | -18 | -12 | |
| | MOIyz | 113 | 164 | |
| 403 | COR | 0.785 | 0.865 | |
| 404 | LOFT | 11 | 13 | DEGREE |
| | LIE | 55 | 55 | |
| | HOSELHEIGHT | 0 | 0 | |
| | SPINCOR | 0 | 0 | |

*FIG. 35*

204

PRE-IMPACT SWING PROPERTIES

| | | GOLFER A | GOLFER B | (AVERAGES) |
|---|---|---|---|---|
| 409 | LINEAR VELOCITY | | | |
| | VX | -100.07 | -107.35 | MPH |
| | VY | -2.12 | 18.04 | |
| | VZ | 5.63 | 9.99 | |
| 410 | ANGULAR VELOCITY | | | OPTIONAL |
| 411 | ORIENTATION | | | |
| | FACE LOFT VECTOR | | | |
| | x | 0.3251 | 0.27673 | |
| | y | -0.07685 | -0.03143 | |
| | z | 0.942547 | 0.96043 | |
| | FACE LIE VECTOR | | | |
| | x | 0.08157 | 0.08518 | |
| | y | 0.9953 | 0.99633 | |
| | z | 0.05302 | 0.00806 | |
| | FACE NORMAL VECTOR | | | |
| | x | -0.94215 | -0.95716 | |
| | y | 0.05965 | 0.07958 | |
| | z | 0.32984 | 0.2784 | |
| | SHAFT VECTOR | | | |
| | x | -0.05612 | -0.01957 | |
| | y | 0.57527 | 0.500194 | |
| | z | -0.81603 | -0.8657 | |
| 412 | IMPACT LOCATION | | | |
| | x | 0.21 | -0.38 | INCH |
| | y | 0.41 | -0.16 | |

FIG. 36

206

GOLF BALL PROPERTIES

| | | TWO PIECE | THREE PIECE | |
|---|---|---|---|---|
| 405 | MASS | 45.387 | 45.23 | GRAM |
| 406 | RADIUS | | | |
| | DIAMETER | 1.68 | 1.678 | INCH |
| 407 | MOMENT | 1.34E-03 | 1.04E-03 | 0INCHS2 |
| 408 | COR | 0.759 | 0.7455 | |

FIG. 37

210 BALL LAUNCH PARAMETERS

POSSIBLE LAUNCH PARAMETERS

| | | GOLFER A STEEL/2PC | STEEL/3PC | Ti/2PC | Ti/3PC | GOLFER B STEEL/2PC | STEEL/3PC | Ti/2PC | Ti/3PC | |
|---|---|---|---|---|---|---|---|---|---|---|
| 416 | BALL LINEAR VELOCITY | 138.3 | 137 | 141.2 | 140.3 | 155.5 | 154.5 | 160.8 | 160 | MPH |
| | VX | 132.6 | 131.2 | 134 | 132.9 | 152.8 | 151.7 | 157 | 156 | |
| | VY | 3.01 | 3.11 | 3.26 | 3.37 | 0.55 | 0.62 | 0.79 | 0.93 | |
| | VZ | 39.2 | 39.5 | 44.4 | 44.9 | 28.9 | 29.5 | 34.8 | 35.4 | |
| 417 | BALL ANGULAR VELOCITY | 2512 | 2667 | 2640 | 2910 | 2820 | 3080 | 2996 | 3280 | MPH |
| 418 | LAUNCH ANGLE | 16.5 | 16.8 | 18.4 | 18.7 | 10.7 | 11 | 12.5 | 12.8 | DEGREE |
| 419 | SIDE ANGLE | 4.4 | 4.5 | 4.2 | 4.3 | 1.1 | 1.2 | 1.3 | 1.5 | DEGREE |
| 420 | BALL SPEED | 138.3 | 137 | 141.2 | 140.3 | 155.5 | 154.5 | 160.8 | 160 | MPH |
| 421 | SPIN | 2512 | 2667 | 2640 | 2910 | 2820 | 3080 | 2996 | 3280 | MPH |
| 422 | SPIN AXIS | 20.784 | 20.724 | 19.172 | 19.089 | 17.56 | 17.436 | 18.845 | 18.705 | DEGREE |

*FIG. 38*

214 ATMOSPHERIC CONDITIONS →

| | NICE | COLD | |
|---|---|---|---|
| TEMP | 72 | 43 | F |
| WIND | 0 | 9 | MPH |
| | 0 | 90 | DIRECTION |
| HUMIDITY | 50 | 76 | PERCENT |
| PRESSURE | 29.92 | 30.33 | INCHES |

*FIG. 39*

218 PREDICTED PERFORMANCE

| | PLAYER<br>WEATHER<br>DRIVER<br>BALL | GOLFER A<br>NICE<br>STEEL<br>2 PIECE | NICE<br>STEEL<br>3 PIECE | COLD<br>STEEL<br>2 PIECE | COLD<br>STEEL<br>3 PIECE | NICE<br>Ti<br>2 PIECE | NICE<br>Ti<br>3 PIECE | COLD<br>Ti<br>2 PIECE | COLD<br>Ti<br>3 PIECE | |
|---|---|---|---|---|---|---|---|---|---|---|
| 422 | TOTAL DISTANCE | 237 | 235 | 232 | 230 | 239 | 234 | 236 | 232 | YARDS |
| 423 | TOTAL DISPERSION | -159 | -160 | -114 | -113 | -157 | -158 | -111 | -112 | FEET |
| 424 | TRAJECTORY SHAPE | (GRAPH) | (GRAPH) | (GRAPH) | (GRAPH) | (GRAPH) | (GRAPH) | (GRAPH) | (GRAPH) | |
| 424 | TRAJECTORY SHAPE | | | | | | | | | |
| | VERTICAL | 88 | 90 | 87 | 87 | 110 | 115 | 108 | 112 | FEET |
| | HORIZONTAL | 27 | 26 | 14 | 13 | 26 | 26 | 13 | 13 | FEET |

| | PLAYER<br>WEATHER<br>DRIVER<br>BALL | GOLFER B<br>NICE<br>STEEL<br>2 PIECE | NICE<br>STEEL<br>3 PIECE | COLD<br>STEEL<br>2 PIECE | COLD<br>STEEL<br>3 PIECE | NICE<br>Ti<br>2 PIECE | NICE<br>Ti<br>3 PIECE | COLD<br>Ti<br>2 PIECE | COLD<br>Ti<br>3 PIECE | |
|---|---|---|---|---|---|---|---|---|---|---|
| 422 | TOTAL DISTANCE | 253 | 254 | 259 | 258 | 261 | 257 | 258 | 255 | YARDS |
| 423 | TOTAL DISPERSION | -116 | -118 | -76 | -75 | -139 | -145 | -91 | -96 | FEET |
| 424 | TRAJECTORY SHAPE | (GRAPH) | (GRAPH) | (GRAPH) | (GRAPH) | (GRAPH) | (GRAPH) | (GRAPH) | (GRAPH) | |
| 424 | TRAJECTORY SHAPE | | | | | | | | | |
| | VERTICAL | 77 | 79 | 75 | 76 | 101 | 107 | 98 | 104 | FEET |
| | HORIZONTAL | 27 | 27 | 15 | 14 | 33 | 33 | 18 | 18 | FEET |

*FIG. 40*

METHOD FOR PREDICTING A GOLFER'S BALL STRIKING PERFORMANCE

CROSS REFERENCES TO RELATED APPLICATIONS

The Present Application is a continuation-in-part application of U.S. patent application Ser. No. 10/843,783, filed on May 11, 2004, which claims priority to U.S. Provisional Application No. 60/498,761, filed on Aug. 28, 2003.

STATEMENT REGARDING FEDERALLY SPONSORED RESEARCH OR DEVELOPMENT

Not Applicable

BACKGROUND OF THE INVENTION

1. Field of the Invention

The present invention relates to a method for predicting a golfer's ball striking performance for a multitude of golf clubs and golf balls. More specifically, the present invention relates to a method for predicting a golfer's ball striking performance for a multitude of golf clubs and golf balls without the golfer actually using the multitude of golf clubs and golf balls.

2. Description of the Related Art

For over twenty-five years, high speed camera technology has been used for gathering information on a golfer's swing. The information has varied from simple club head speed to the spin of the golf ball after impact with a certain golf club. Over the years, this information has fostered numerous improvements in golf clubs and golf balls, and assisted golfers in choosing golf clubs and golf balls that improve their game. Additionally, systems incorporating such high speed camera technology have been used in teaching golfers how to improve their swing when using a given golf club.

An example of such a system is U.S. Pat. No. 4,063,259 to Lynch et al., for a Method Of Matching Golfer With Golf Ball, Golf Club, Or Style Of Play, which was filed in 1975. Lynch discloses a system that provides golf ball launch measurements through use of a shuttered camera that is activated when a club head breaks a beam of light that activates the flashing of a light source to provide stop action of the club head and golf ball on a camera film. The golf ball launch measurements retrieved by the Lynch system include initial velocity, initial spin velocity and launch angle.

Another example is U.S. Pat. No. 4,136,387 to Sullivan, et al., for a Golf Club Impact And Golf Ball Launching Monitoring System, which was filed in 1977. Sullivan discloses a system that not only provides golf ball launch measurements, it also provides measurements on the golf club.

Yet another example is a family of patent to Gobush et al., U.S. Pat. No. 5,471,383 filed on Sep. 30, 1994; U.S. Pat. No. 5,501,463 filed on Feb. 24, 1994; U.S. Pat. No. 5,575,719 filed on Aug. 1, 1995; and U.S. Pat. No. 5,803,823 filed on Nov. 18, 1996. This family of patents discloses a system that has two cameras angled toward each other, a golf ball with reflective markers, a golf club with reflective markers thereon and a computer. The system allows for measurement of the golf club or golf ball separately, based on the plotting of points.

Yet another example is U.S. Pat. No. 6,042,483 for a Method Of Measuring Motion Of A Golf Ball. The patent discloses a system that uses three cameras, an optical sensor means, and strobes to obtain golf club and golf ball information.

However, these disclosures fail to provide a system or method that will predict a golfer's performance with a specific golf club or golf ball in different atmospheric conditions, without having the golfer physically strike the specific golf ball with the specific golf club. More specifically, if a golfer wanted to know what his ball striking performance would be like when he hit a CALLAWAY GOLF® RULE 35® SOFTFEEL™ golf ball with a ten degrees CALLAWAY GOLF® BIG BERTHA® ERC® II forged titanium driver, the prior disclosures would require that the golfer actually strike the CALLAWAY GOLF® RULE 35® SOFTFEEL™ golf ball with a ten degrees CALLAWAY GOLF® BIG BERTHA® ERC® II forged titanium driver. Using the prior disclosures, if the golfer wanted to compare his or her ball striking performance for ten, twenty or thirty drivers with one specific golf ball, then the golfer would have use each of the drivers at least once. This information would only apply to the specific golf ball that was used by the golfer to test the multitude of drivers. Now if the golfer wanted to find the best driver and golf ball match, the prior disclosures would require using each driver with each golf ball. Further, if the golfer wanted the best driver/golf ball match in a multitude of atmospheric conditions (e.g. hot and humid, cool and dry, sunny and windy, . . . etc.) the prior disclosures would require that the golfer test each driver with each golf ball under each specific atmospheric condition.

Thus, the prior disclosures fail to disclose a system and method that allow for predicting a golfer's ball striking performance for a multitude of golf clubs and golf balls without the golfer actually using the multitude of golf clubs and golf balls.

BRIEF SUMMARY OF THE INVENTION

It is thus an object of the present invention to provide a system and method that allow for predicting a golfer's ball striking performance for a multitude of golf clubs and golf balls without the golfer actually using the multitude of golf clubs and golf balls.

BRIEF DESCRIPTION OF THE SEVERAL VIEWS OF THE DRAWINGS

FIG. 31 is a flow chart of the components of the pre-swing properties of FIG. 1.

FIG. 32 is a table of the image times (in microseconds) of FIG. 31 for Golfer A and Golfer B.

FIG. 33 is a table of the measured points (in millimeters) of FIG. 31 for Golfer A and Golfer B.

FIG. 34 is a table of the static image points (in millimeters) of FIG. 31 for Golfer A and Golfer B.

FIG. 35 is a table of the golf club head properties of FIGS. 1 and 1A for Golfer A and Golfer B.

FIG. 36 is a table of the pre-impact swing properties of FIGS. 1 and 1C for Golfer A and Golfer B.

FIG. 37 is a table of the golf ball properties of FIGS. 1 and 1B for Golfer A and Golfer B.

FIG. 38 is a table of the ball launch parameters of FIGS. 1 and 1D for Golfer A and Golfer B.

FIG. 39 is a table of the atmospheric conditions of FIG. 1 for a warm day and a cold day.

FIG. 40 is a table of the predicted performance of FIGS. 1 and 1E for Golfer A and Golfer B.

DETAILED DESCRIPTION OF THE INVENTION

Figure 1:
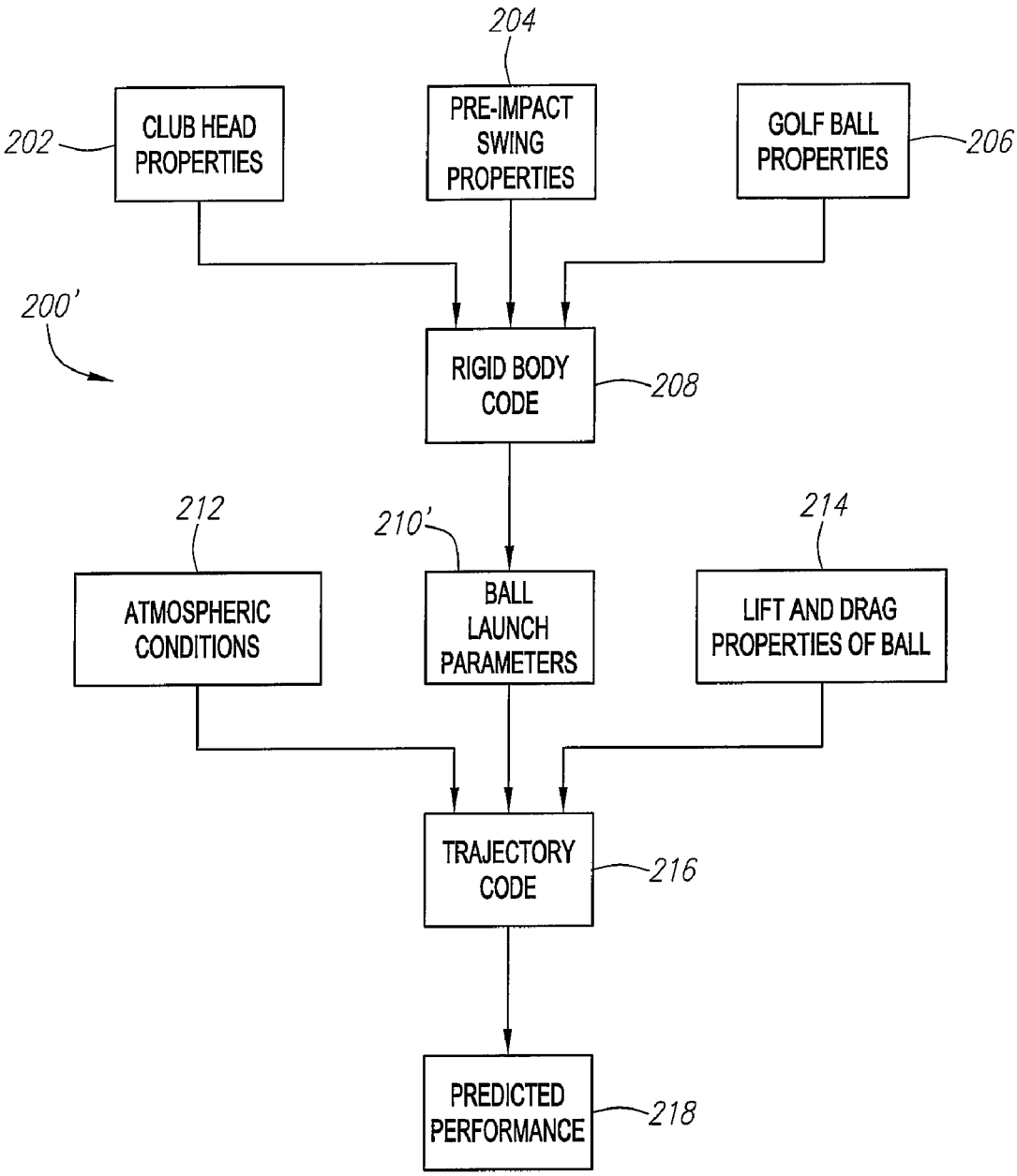
FIG. 1 is a flow chart of the general method of the present invention.

As shown in FIG. 1, a method for predicting a golfer's ball striking performance is generally designated 200'. The method 200' commences with inputting information on a specific golf club, specific golf ball, and the swing characteristics of a golfer. At block 202, the club head properties of the specific golf club are selected from a database of stored and previously collected club head information. The specific information for the club head properties is set forth in greater detail below. At block 204, the pre-impact swing properties of the golfer are collected and stored in a database. The specific information for the golfer's pre-impact swing properties is set forth in greater detail below. At block 206, the golf ball properties of the specific golf ball are selected from database of stored and previously collected golf ball information. The specific information for the golf ball properties is set forth in greater detail below.

At block 208, the information from blocks 202, 204 and 206 are inputted into a rigid body code. The rigid body code is explained in greater detail below. At block 210', the rigid body code is used to generate a plurality of ball launch parameters. At block 212, information concerning the atmospheric conditions is selected from a database of stored atmospheric conditions. At block 214, information concerning the lift and drag properties of the golf ball are collected and stored. The lift and drag properties of golf balls are measured using conventional methods such as disclosed in U.S. Pat. No. 6,186,002, entitled Method For Determining Coefficients Of Lift And Drag Of A Golf Ball, which is hereby incorporated by reference in its entirety. The lift and drag coefficients of a number of golf balls at specific Reynolds numbers are disclosed in U.S. Pat. No. 6,224,499, entitled A Golf Ball With Multiple Sets Of Dimples, which pertinent parts are hereby incorporated by reference.

At block 216, the ball launch parameters, the atmospheric conditions and the lift and drag properties are inputted into a trajectory code. At block 218, the trajectory code is utilized to predict the performance of the golfer when swinging the specific golf club, with the specific golf ball under the specific atmospheric conditions. Trajectory codes are known in the industry, and one such code is disclosed in the afore-mentioned U.S. Pat. No. 6,186,002. The USGA has such a trajectory code available for purchase.

Figure 1A:
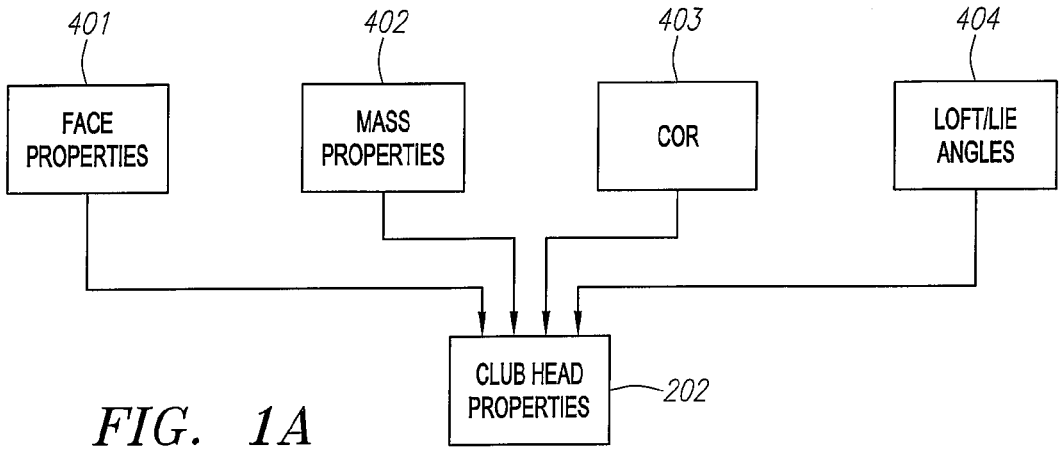
FIG. 1A is a flow chart illustrating the inputs for the golf club head properties.

FIG. 1A is a flow chart illustrating the inputs for the golf club head properties of block 202. The measurements for the face properties are collected at block 401. The face properties include the face geometry, the face center, the bulge radius and the roll radius. The measurements for the mass properties of the golf club head are collected or recalled from a database at block 402. The mass properties include the inertia tensor, the mass of the club head, and the center of gravity location. The measurement for the coefficient of restitution of the golf club head using a specific golf ball is collected at block 403. The measurements for the loft and lie angles of the golf club head are collected at block 404. The data collected at blocks 401-404 is inputted to create the golf club head properties at block 202 of FIG. 1. Such a golf club head is disclosed in Stevens et al., U.S. Pat. No. 7,169,060 for a Golf Club Head, assigned to Callaway Golf Company, which discloses a golf club head with high moment of inertias about a center of gravity of the golf club head, and which is hereby incorporated by reference in its entirety. The golf club head of Stevens et al., has a volume preferably ranging from 420 cubic centimeters to 470 cubic centimeters, an moment of inertia Izz preferably ranging from 3500 g-cm$^2$ to 6000 g-cm$^2$, a COR preferably ranging from 0.81 to 0.94, and a mass preferably ranging from 180 grams to 215 grams. The golf club head of Stevens et al., also preferably has a face area ranging from 6.0 square inches to 9.5 square inches, and the golf club head has a substantially square shape.

Figure 1B:
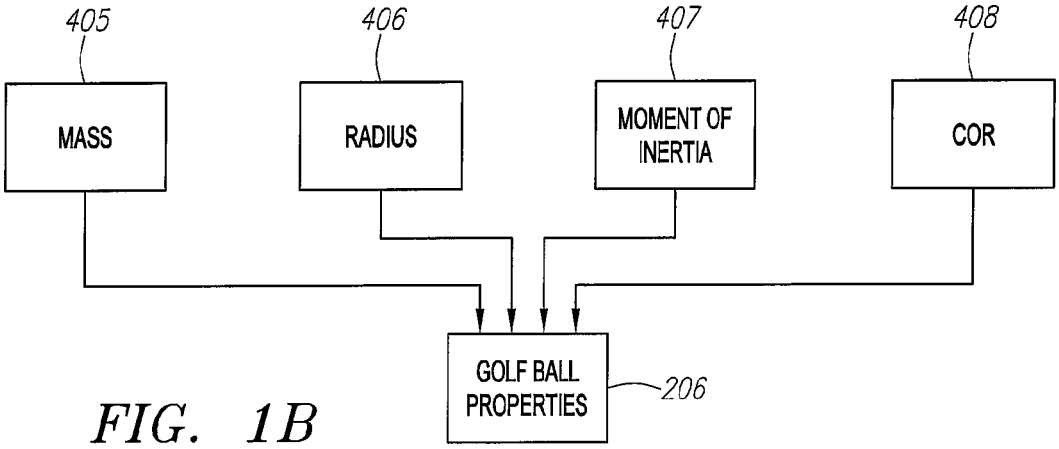
FIG. 1B is a flow chart illustrating the inputs for the golf ball properties.

FIG. 1B is a flow chart illustrating the inputs for the golf ball properties of block 206. The measurement of the mass of the golf ball is collected at block 405. The measurement of the radius of the golf ball is collected at block 406. The measurement of the moment of inertia of the golf ball is collected at block 407. The measurement of the coefficient of restitution of the golf ball is collected at block 408. The data collected at blocks 405-408 is inputted to create the golf ball properties at block 206 of FIG. 1.

Figure 1C:
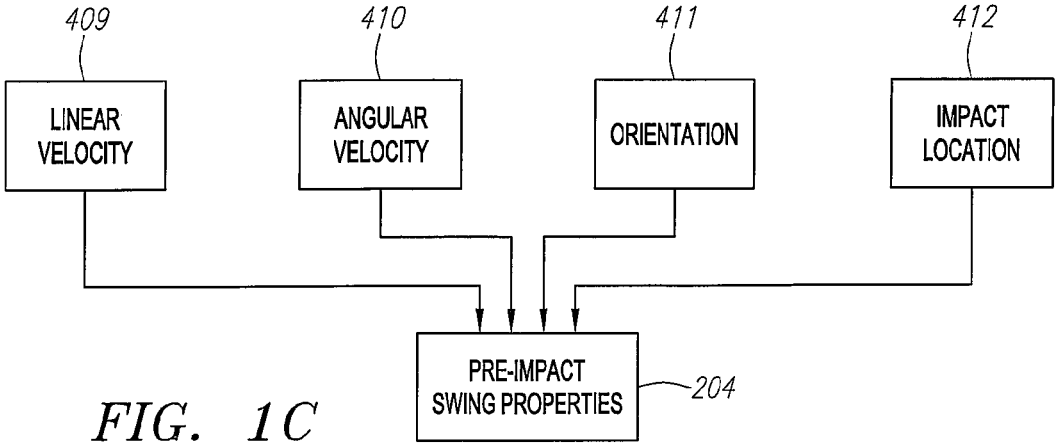
FIG. 1C is a flow chart illustrating the inputs for the pre-impact swing properties.

FIG. 1C is a flow chart illustrating the inputs for the pre-impact swing properties of block 204. The measurement of the linear velocity of the golf club being swung by the golfer is collected at block 409. The measurement of the angular velocity of the golf club being swung by the golfer is collected at block 410. The measurement of the golf club head orientation is collected at block 411. The information of the club head impact location with the golf ball is determined at block 412. The data collected at blocks 409-412 is inputted to create the pre-impact swing properties at block 204 of FIG. 1.

Figure 1D:
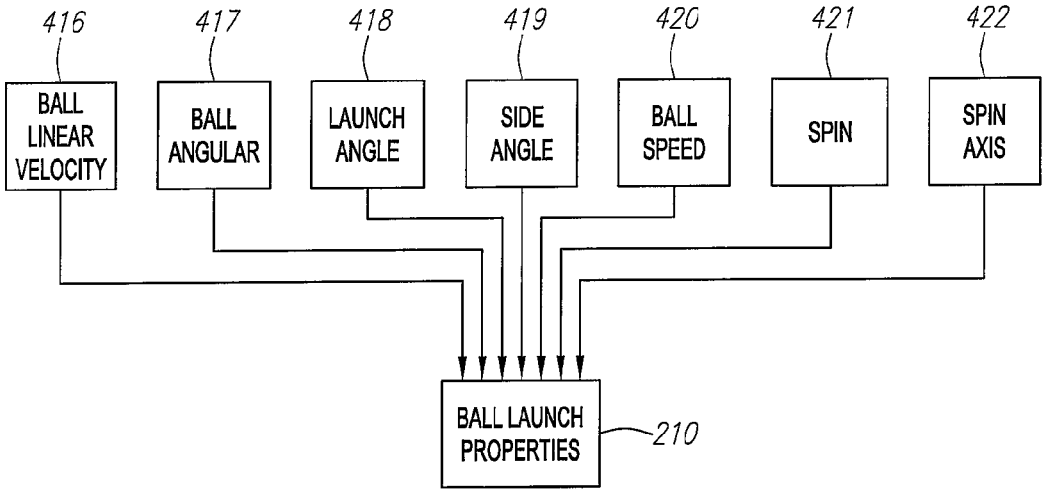
FIG. 1D is a flow chart of the inputs for the ball launch parameters.

FIG. 1D is a flow chart of the inputs for the ball launch parameters at block 214 of FIG. 1. The post impact linear velocity of the golf ball is calculated at block 416. The post impact angular velocity of the golf ball is calculated at block 417. The launch angle of the golf ball is calculated at block 418. The side angle of the golf ball is calculated at block 419. The speed of the golf ball is calculated at block 420. The spin of the golf ball is calculated at block 421. The spin axis of the golf ball is calculated at block 421. The information from blocks 416-421 is inputted to the ball launch parameters at block 214 of FIG. 1.

Figure 1E:
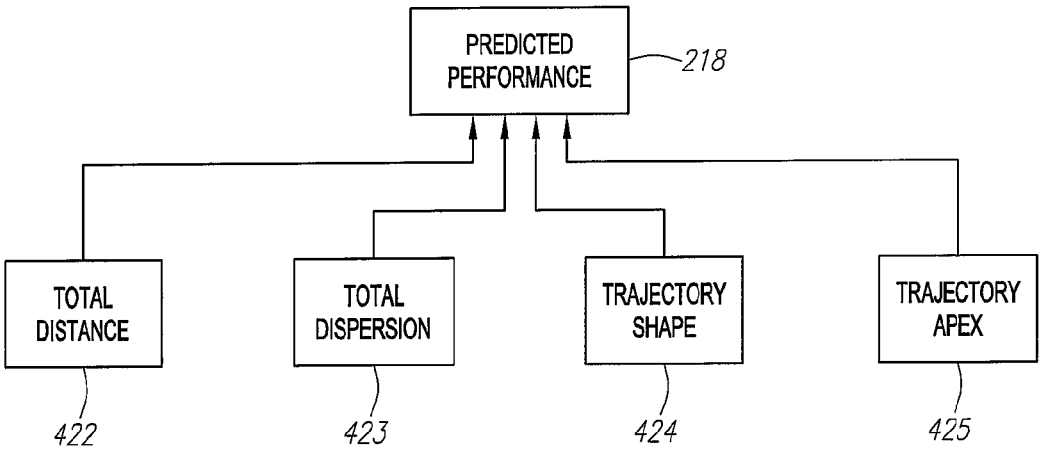
FIG. 1E is a flow chart of the outputs that are generated for the predicted performance.

FIG. 1E is a flow chart of the outputs from the trajectory code that are generated for the predicted performance of block 218 of FIG. 1. Block 422 is the predicted total distance of the golf ball if struck with a specific golf club by a golfer. Block 423 is the predicted total dispersion of the golf ball if struck with a specific golf club by a golfer. Block 424 is the predicted trajectory shape (available in 3D or 2D) of the golf ball if struck with a specific golf club by a golfer. Block 425 is the predicted trajectory apex of the golf ball if struck with a specific golf club by a golfer.

The golf club head properties of block 202 that are collected and stored in the system include the mass of the golf club head, the face geometry, the face center location, the bulge radius of the face, the roll radius of the face, the loft angle of the golf club head, the lie angle of the golf club head, the coefficient of restitution ("COR") of the golf club head, the location of the center of gravity, CG, of the golf club head relative to the impact location of the face, and the inertia tensor of the golf club head about the CG.

The mass, bulge and roll radii, loft and lie angles, face geometry and face center are determined using conventional methods well known in the golf industry. The inertia tensor is calculated using: the moment of inertia about the x-axis, Ixx; the moment of inertia about the y-axis, Iyy; the moment of inertia about the z-axis, Izz; the product of inertia Ixy; the product of inertia Izy; and the product of inertia Izx. The CG and the MOI of the club head are determined according to the teachings of U.S. Pat. No. 6,607,452, entitled High Moment of Inertia Composite Golf Club, assigned to Callaway Golf Company, the assignee of the present application, and hereby incorporated by reference in its entirety. The products of inertia Ixy, Ixz and Izy are determined according to the teachings of U.S. Pat. No. 6,425,832, assigned to Callaway Golf Company, the assignee of the present application, and hereby incorporated by reference in its entirety.

The COR of the golf club head is determined using a method used by the United States Golf Association ("USGA") and disclosed at www.usga.org, or using the method and system disclosed in U.S. Pat. No. 6,585,605, entitled Measurement Of The Coefficient Of Restitution Of A Golf Club, assigned to Callaway Golf Company, the assignee of the present application, and hereby incorporated by reference in its entirety. However, the COR of the golf club head is predicated on the golf ball, and will vary for different types of golf balls.

The golf ball properties of block 206 that are stored and collected include the mass of the golf ball (the Rules of Golf, as set forth by the USGA and the R&A, limit the mass to 45 grams or less), the radius of the golf ball (the Rules of Golf require a diameter of at least 1.68 inches), the COR of the golf ball and the MOI of the golf ball. The MOI of the golf ball may be determined using method well known in the industry. One such method is disclosed in U.S. Pat. No. 5,899,822, which pertinent parts are hereby incorporated by reference. The COR is determined using a method such as disclosed in U.S. Pat. No. 6,443,858, entitled Golf Ball With A High Coefficient Of Restitution, assigned to Callaway Golf Company, the assignee of the present application, and which pertinent parts are hereby incorporated by reference.

The pre-impact swing properties are preferably determined using an acquisition system with CMOS cameras. The pre-impact swing properties include golf club head orientation, golf club head velocity, and golf club spin. The golf club head orientation includes dynamic lie, loft and face angle of the golf club head. The golf club head velocity includes path of the golf club head and attack of the golf club head.

Figure 2:
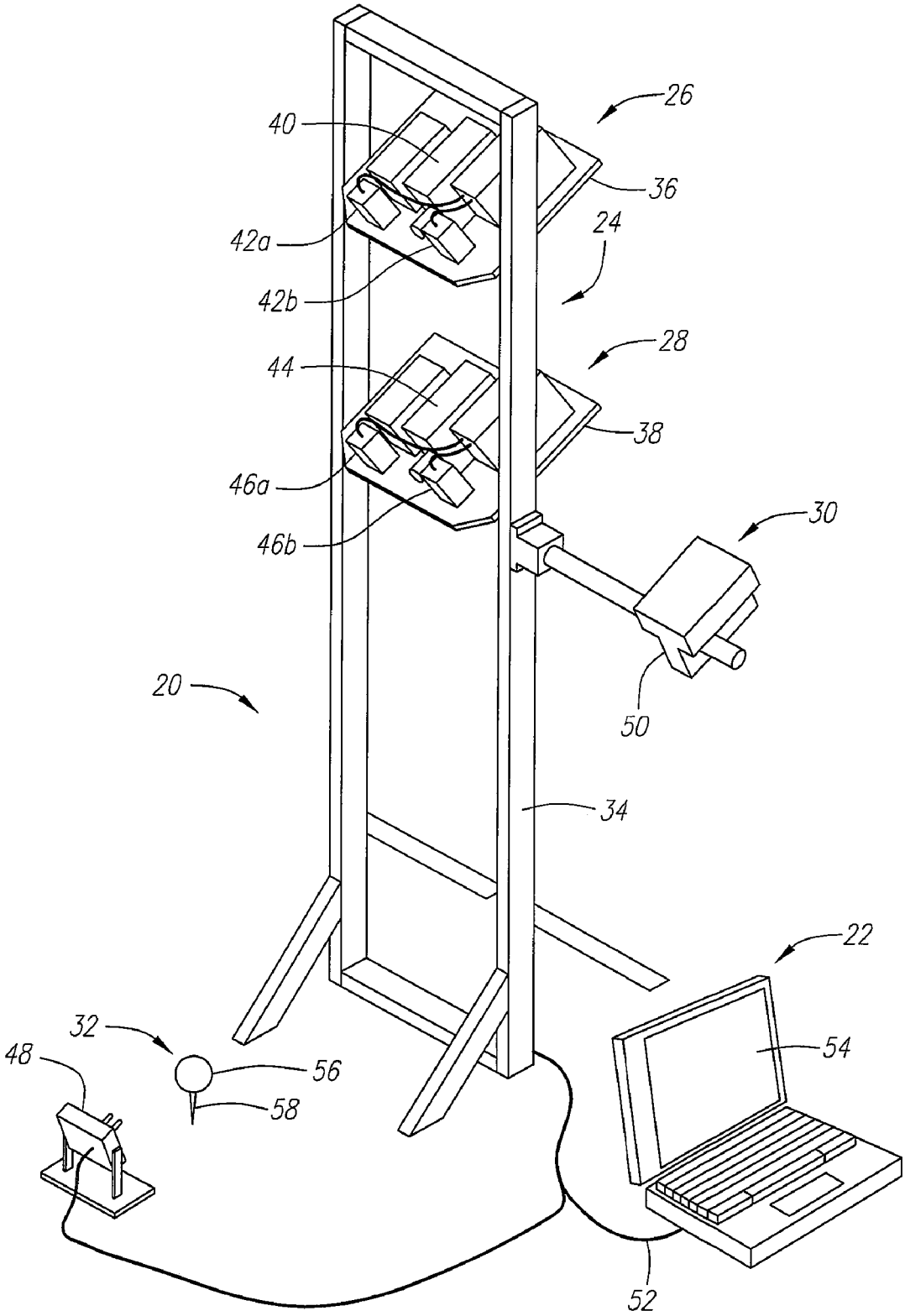
FIG. 2 is a perspective view of the monitoring system of the present invention.
Figure 2A:
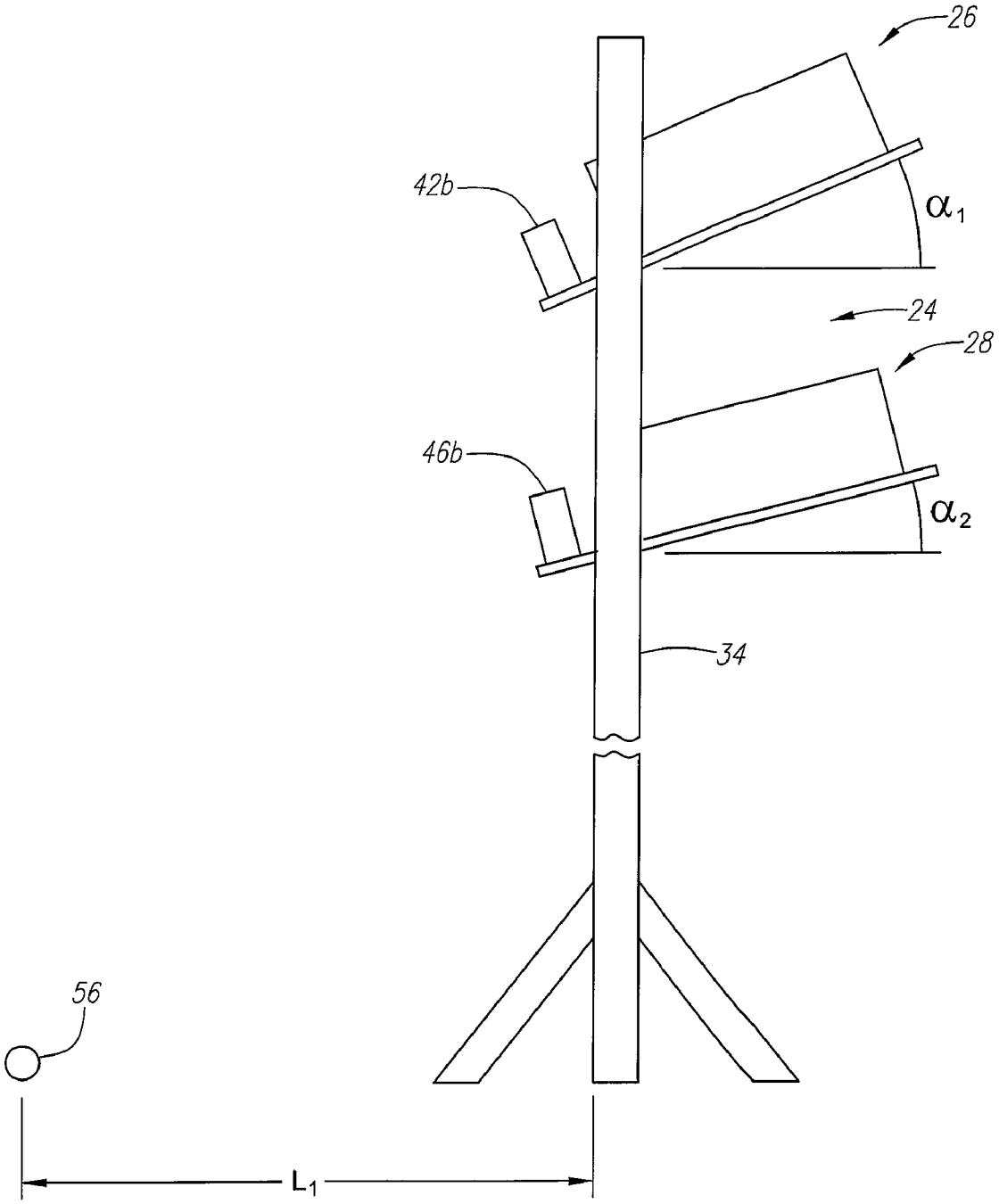
FIG. 2A is a schematic isolated side view of the teed golf ball and the cameras of the system of the present invention.
Figure 3:
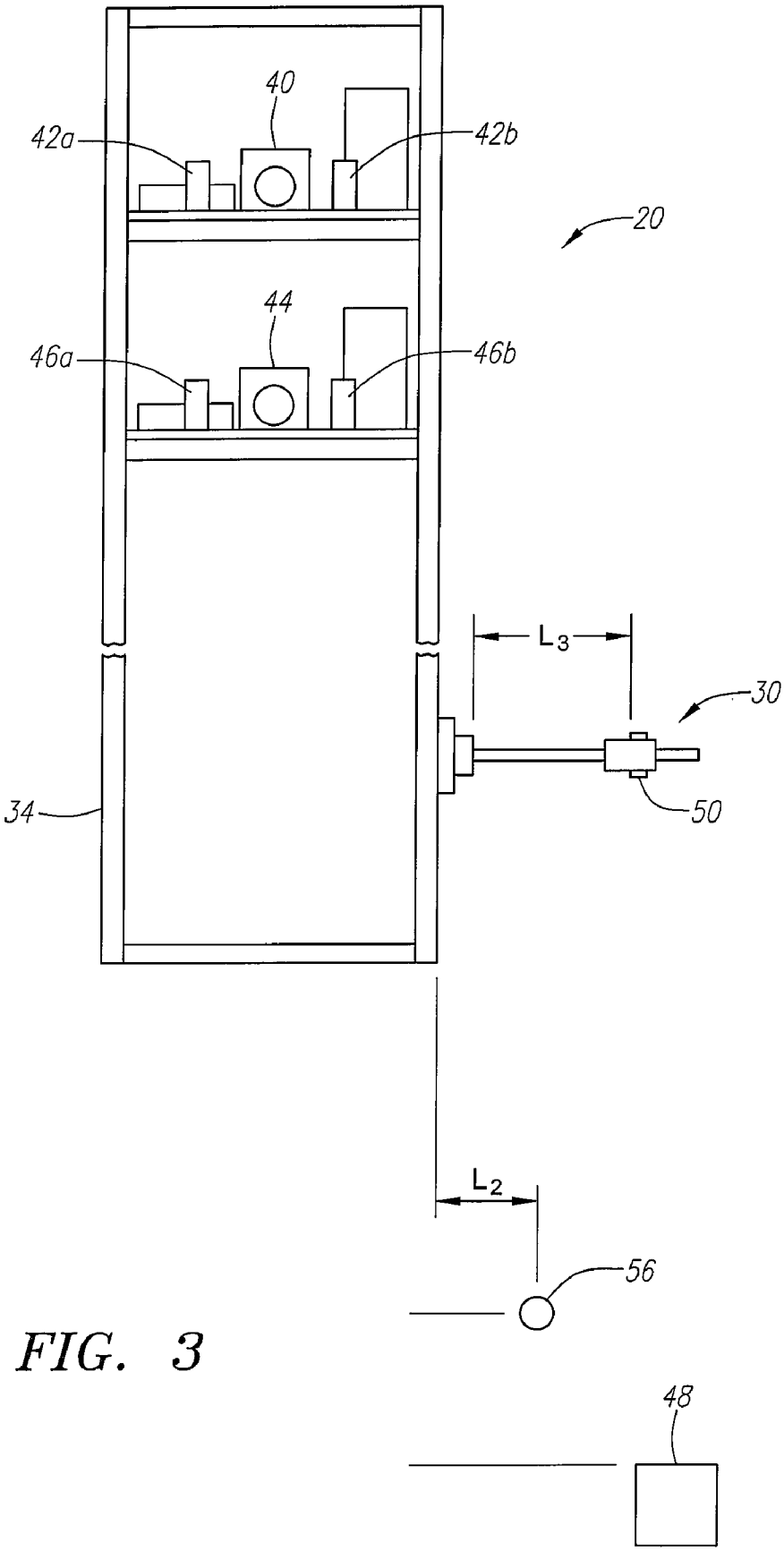
FIG. 3 is a schematic isolated front view of the teed golf ball, trigger device and the cameras of the system of the present invention.

As shown in FIGS. 2-3, the system of the present invention is generally designated 20. The system 20 captures and analyzes golf club information and golf ball information during and after a golfer's swing. The golf club information includes golf club head orientation, golf club head velocity, and golf club spin. The golf club head orientation includes dynamic lie, loft and face angle of the golf club head. The golf club head velocity includes path of the golf club head and attack of the golf club head. The golf ball information includes golf ball velocity, golf ball launch angle, golf ball side angle, golf ball speed and golf ball orientation. The golf ball orientation includes the true spin of the golf ball, and the tilt axis of the golf ball which entails the back spin and the side spin of the golf ball. The various measurements will be described in greater detail below.

The system 20 generally includes a computer 22, a camera structure 24 with a first camera unit 26, a second camera unit 28 and an optional trigger device 30, a golf ball 32 and a golf club 33. The system 20 is designed to operate on-course, at a driving range, inside a retail store/showroom, or at similar facilities.

In a preferred embodiment, the camera structure 24 is connected to a frame 34 that has a first platform 36 approximately 46.5 inches from the ground, and a second platform 38 approximately 28.5 inches from the ground. The first camera unit 26 is disposed on the first platform 36 and the second camera unit 28 is disposed on the second platform 38. As shown in FIG. 2, the first platform 36 is at an angle $\alpha_1$ which is approximately 41.3 degrees relative to a line perpendicular to the straight frame vertical bar of the frame 34, and the second platform 38 is at an angle $\alpha_2$ which is approximately 25.3 degrees relative to a line perpendicular to the straight frame vertical bar of the frame 34. However, those skilled in the relevant art will recognize that other angles may be utilized for the positioning of the cameras without departing from the scope and spirit of the present invention.

Figure 2B:
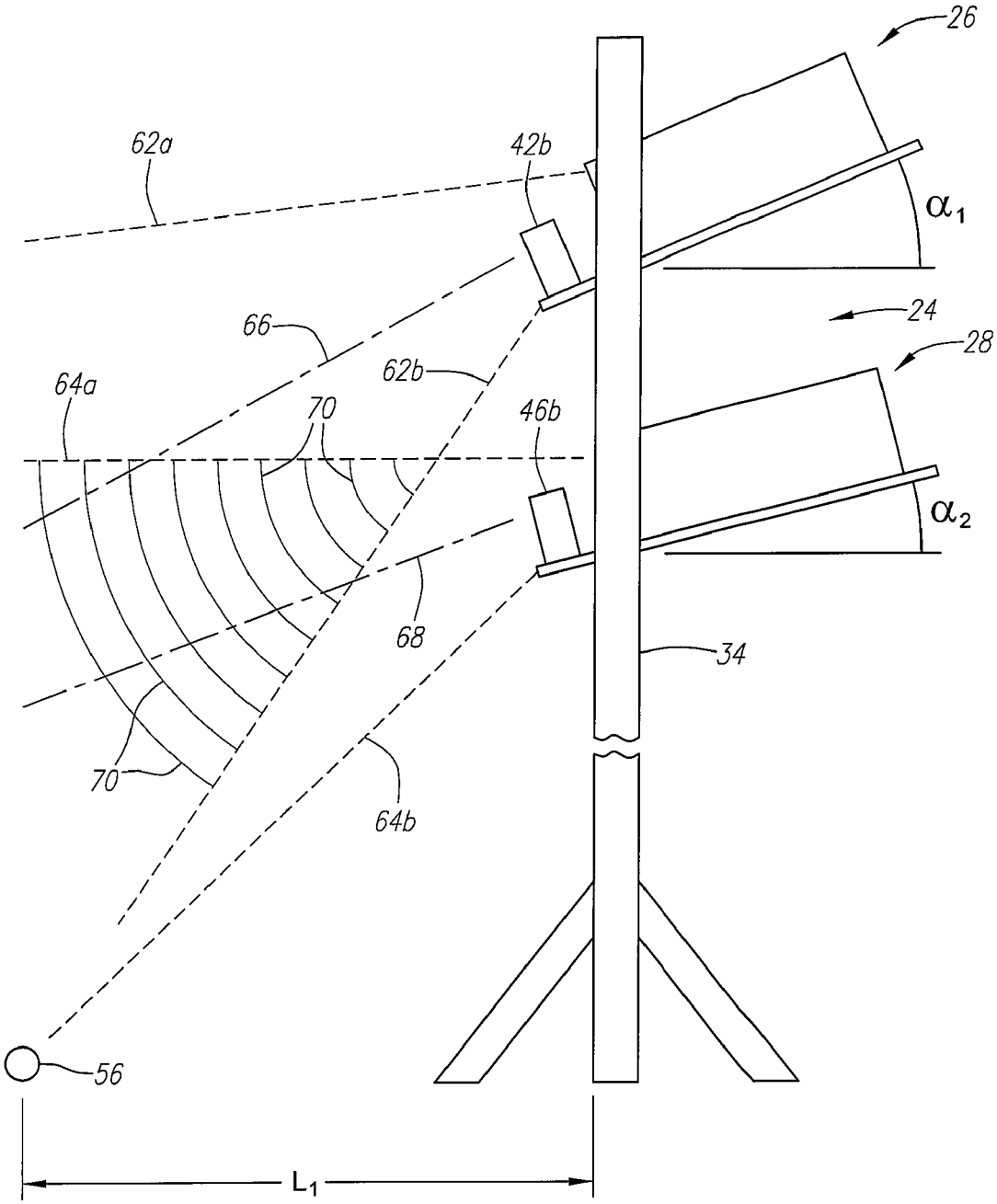
FIG. 2B is a schematic isolated side view of the teed golf ball and the cameras of the system showing the field of view of the cameras.

As shown in FIG. 2B, the platforms 36 and 38 are preferably positioned such that the optical axis 66 of the first camera unit 26 does not overlap/intersect the optical axis 68 of the second camera unit 28. The optical view of the first camera unit 26 is preferably bound by lines 62*a* and 62*b*, while the optical view of the second camera unit 28 is bound by lines 64*a* and 64*b*. The overlap area defined by curves 70 is the field of view of the system 20.

The first camera unit 26 preferably includes a first camera 40 and optional flash units 42*a* and 42*b*. The second camera unit 28 preferably includes a second camera 44 and optional flash units 46*a* and 46*b*. A preferred camera is a complementary metal oxide semiconductor ("CMOS") camera with active pixel technology and a full frame rate ranging from 250 to 500 frames per second.

The optional trigger device 30 includes a receiver 48 and a transmitter 50. The transmitter 50 is preferably mounted on the frame 34 a predetermined distance from the camera units 26 and 28. The golf ball is preferably placed on a tee 58. The golf ball 32 is a predetermined length from the frame 34, $L_1$, and this length is preferably 38.5 inches. However, those skilled in the pertinent art will recognize that the length may vary depending on the location and the placement of the first and second camera units 26 and 28. The transmitter 50 is preferably disposed from 10 inches to 14 inches from the cameras 40 and 44.

The data is collected by the cameras and preferably sent to the computer 22 via a cable 52 which is connected to the receiver 48 and the first and second camera units 26 and 28. The computer 22 has a monitor 54 for displaying images generated by the first and second camera units 26 and 28.

The field of view of the cameras 40 and 44 corresponds to the CMOS sensor array 100. In a preferred embodiment, the CMOS sensor array 100 is at least one megapixel in size having one thousand rows of pixels and one thousand columns of pixels for a total of one million pixels.

Figure 4:
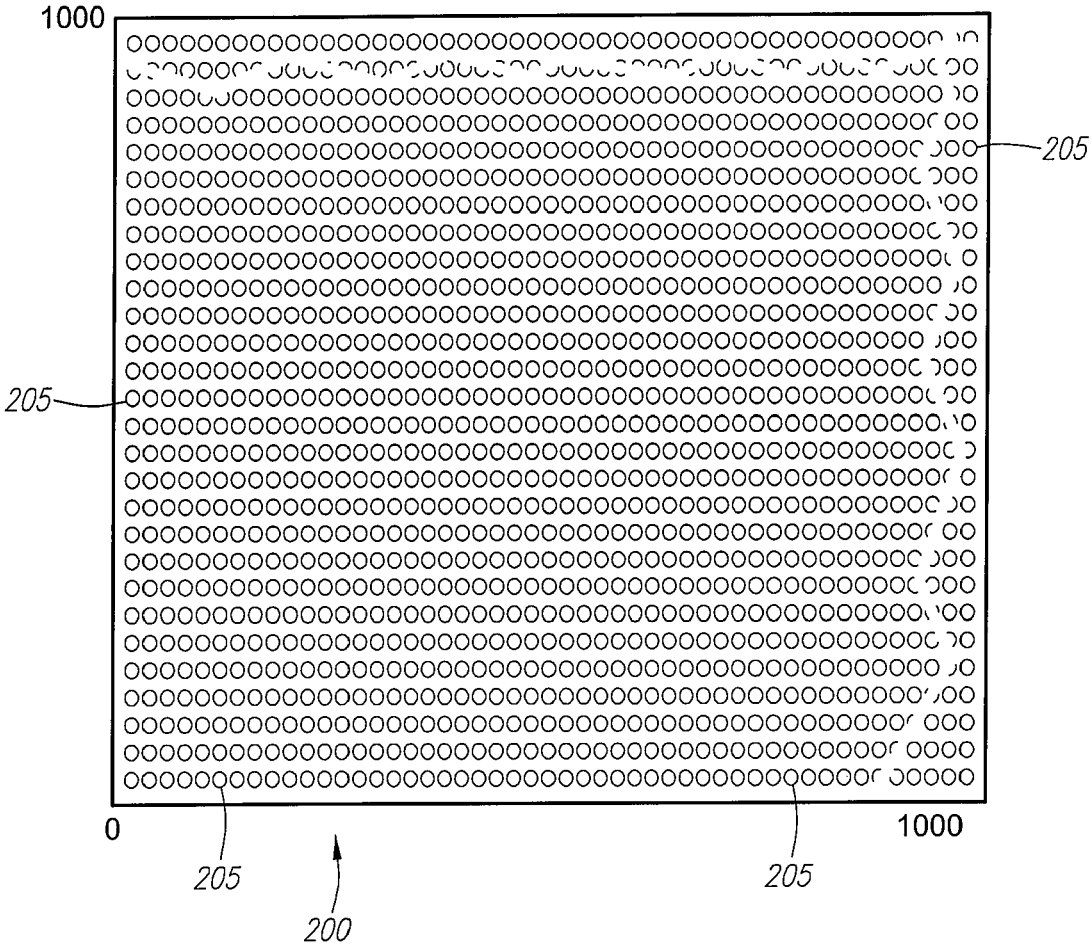
FIG. 4 is a schematic representation of a full frame CMOS sensor array.
Figure 5:
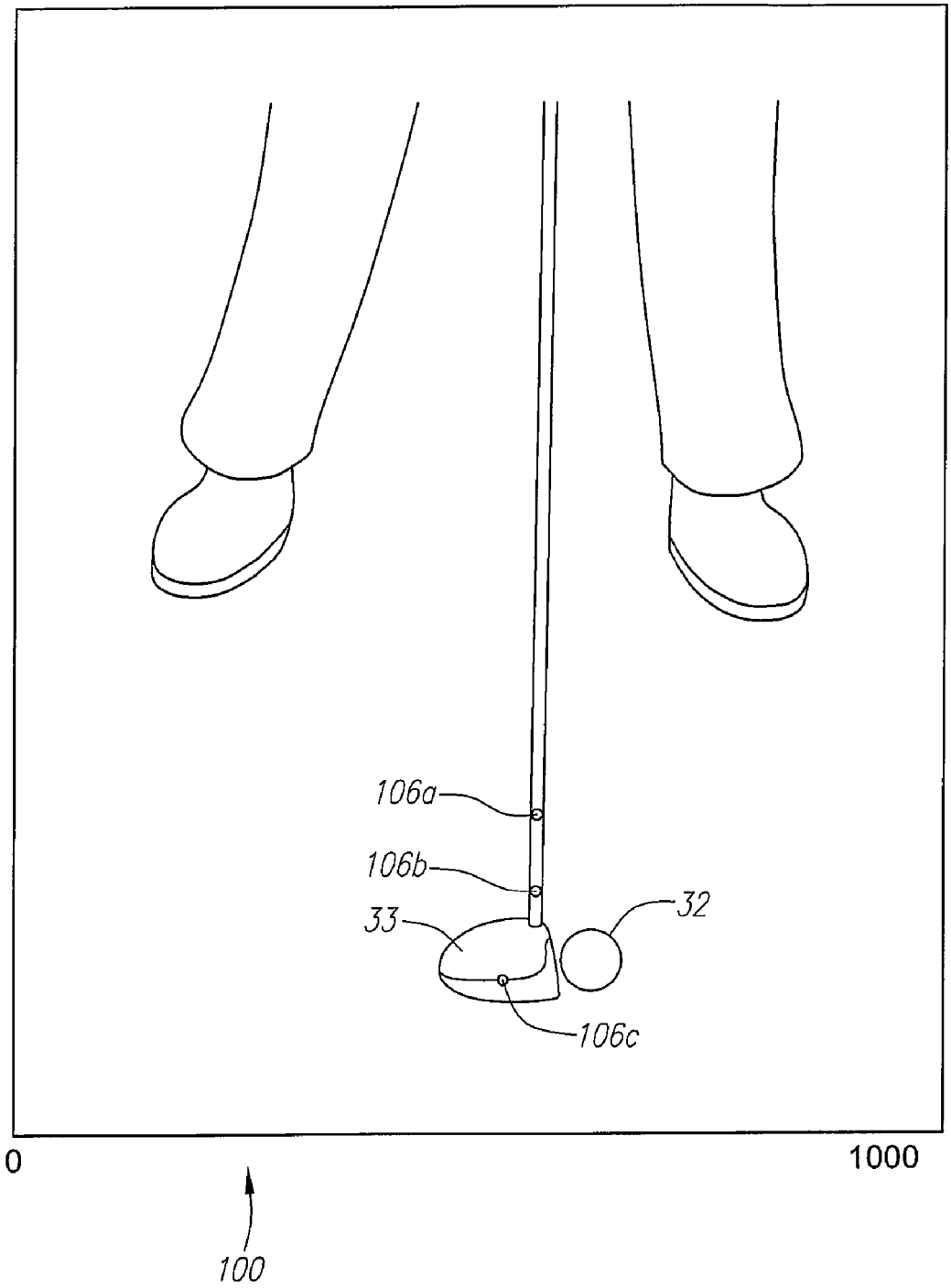
FIG. 5 is a schematic representation of a field of view.

As shown in FIG. 4, a CMOS sensor array 200 preferably has one million active pixels 205. Each active pixel 205 is capable of acting as a single camera to provide an image or a portion of an image. As shown in FIG. 5, the field of view 100 corresponds to the full frame sensor array 200, which preferably operates at a minimum frame rate ranging from 250 to 500 frames per second, however, it may have a frame rate as low as 30 frames per second. At this frame rate, the CMOS sensor array is monitoring the field of view at a rate of 250-500 times per second and is capable of creating images at 250 to 500 times per second. The CMOS sensor array 200 preferably has one thousand columns of active pixels 205 and one thousand rows of active pixels 205. In a preferred embodiment, the field of view 100 is large enough to capture pre-impact golf club information and post-impact golf ball information. However, those skilled in the pertinent art will recognize that the field of view 100 may be adjusted to focus on any particular action by the golfer such as only pre-impact information, putting information, and the like.

Figure 6:
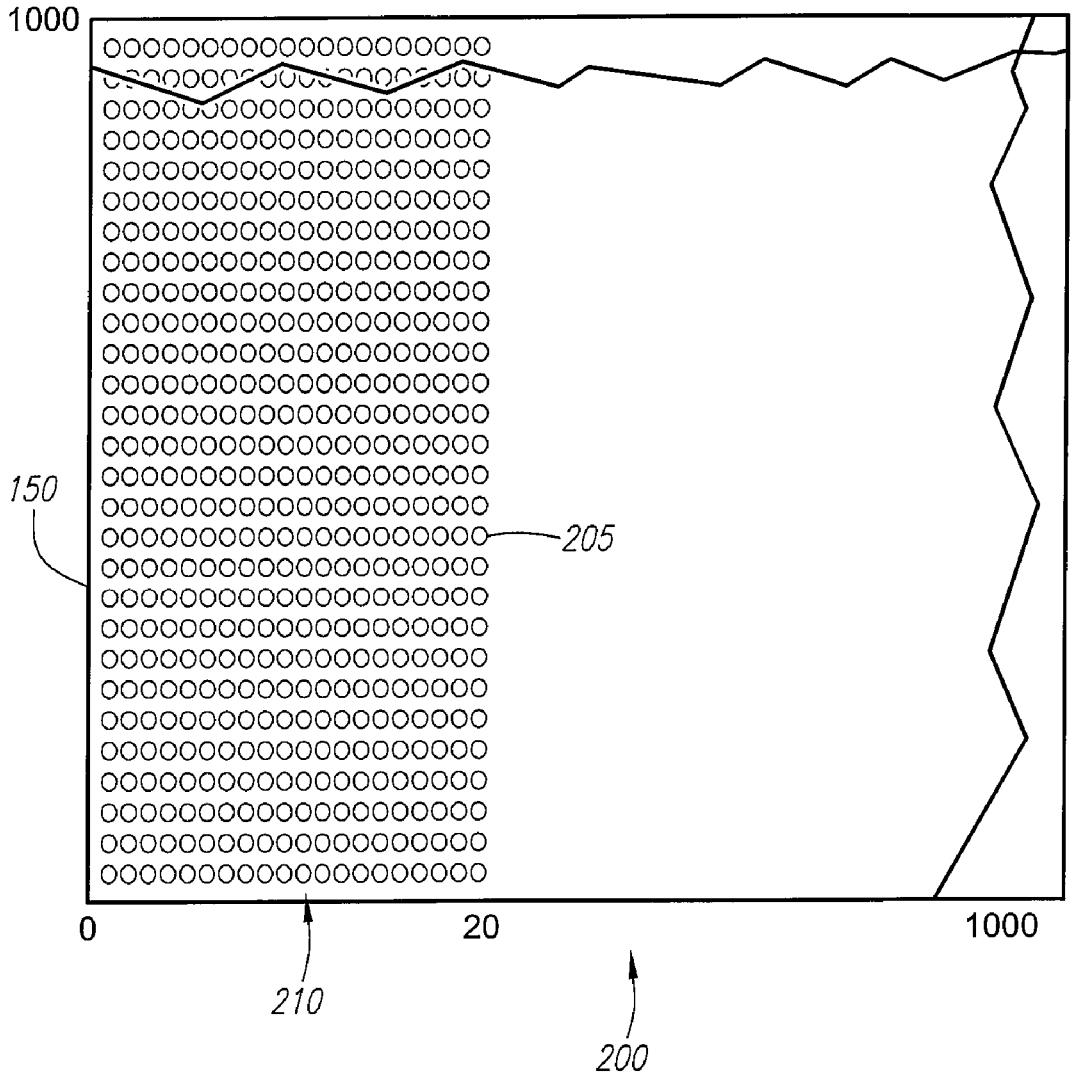
FIG. 6 a schematic representation of a ROI within the CMOS sensor array.

As shown in FIG. 6, an initial region of interest ("ROI") 210 is established at the edge 150 of the field of view 100 or CMOS sensor array 200. In a preferred embodiment, the initial ROI 210 extends along all of the rows of the sensor array 200 and from 10 to 100 columns of the CMOS sensor array 200 beginning with the first column of active pixels 205 at the edge 150. In establishing an ROI, only those pixels within the ROI are activated while the pixels outside of the ROI are deactivated. Reducing the number of active pixels 205 increases the frame rate in a pseudo-inverse relationship. Thus, if only 25% of the active pixels of the CMOS sensor array are activated, and the full frame rate of the CMOS sensor array 200 is 500 frames per second. Then, the frame rate of the ROI is 2000 frames per second. Thus, reducing the number of active pixels 205 allows for the increased monitoring of a ROI thereby providing increased information about an object entering the ROI since an increased number of images may be obtained of the object within the ROI.

Figure 7:
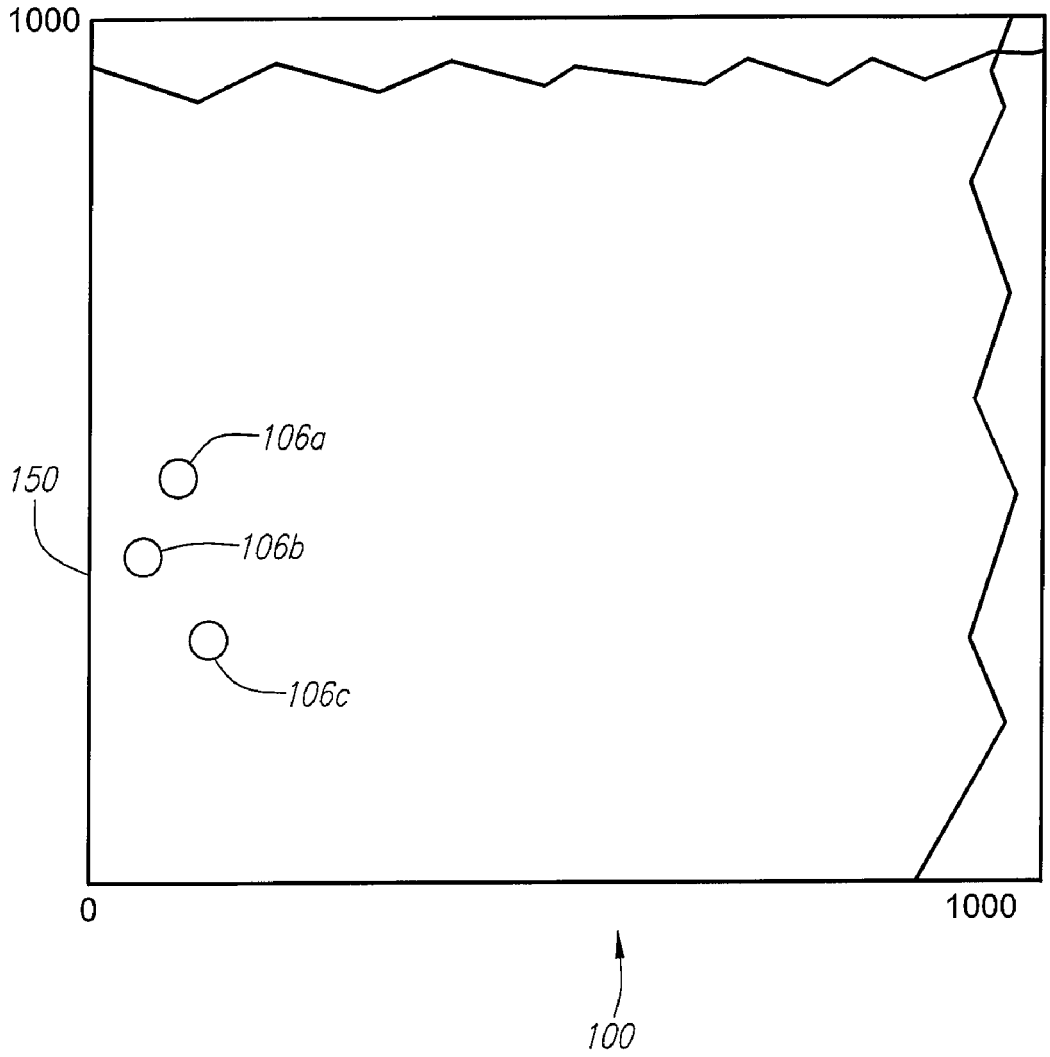
FIG. 7 a schematic representation of an object within the field of view.

The establishment of an ROI 210 at the edge 150 allows for "through the lens" triggering of the system 20. The through the lens triggering is a substitute for the triggering device 30. The system 20 is monitoring the ROI 210 at a very high frame rate, 1000 to 4000 frames per second, to detect any activity, or the appearance of the golf club 33. The system 20 can be instructed to monitor the ROI 210 for a certain brightness provided by the reflected dots 106*a-c*. Once the system 20 detects the object in the ROI 210, the cameras are instructed to gather information on the object. FIG. 7 illustrates the object or golf club, shown as reflective dots 106*a-c*, as entering the field of view 100.

Figure 8:
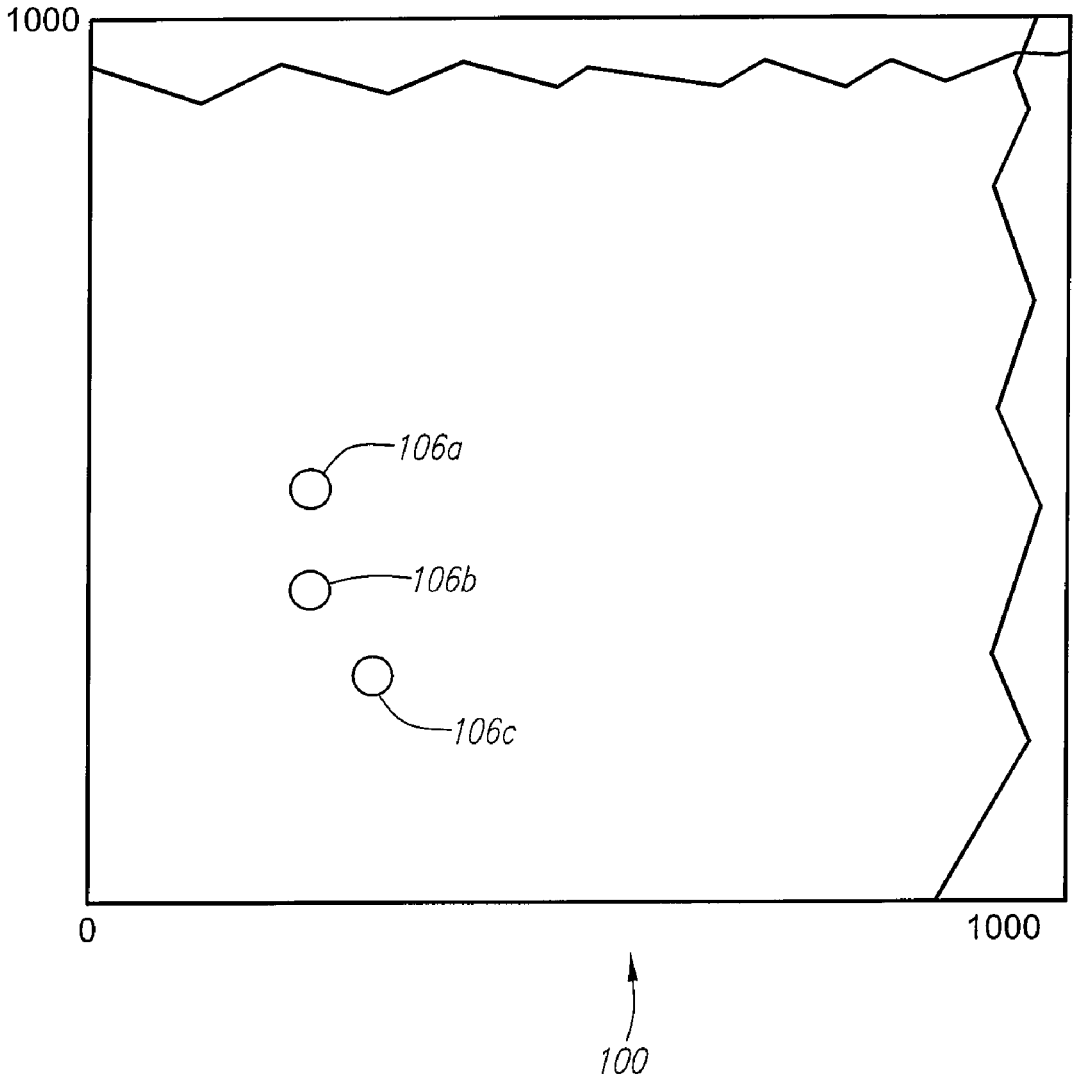
FIG. 8 a schematic representation of an object within the field of view.
Figure 9:
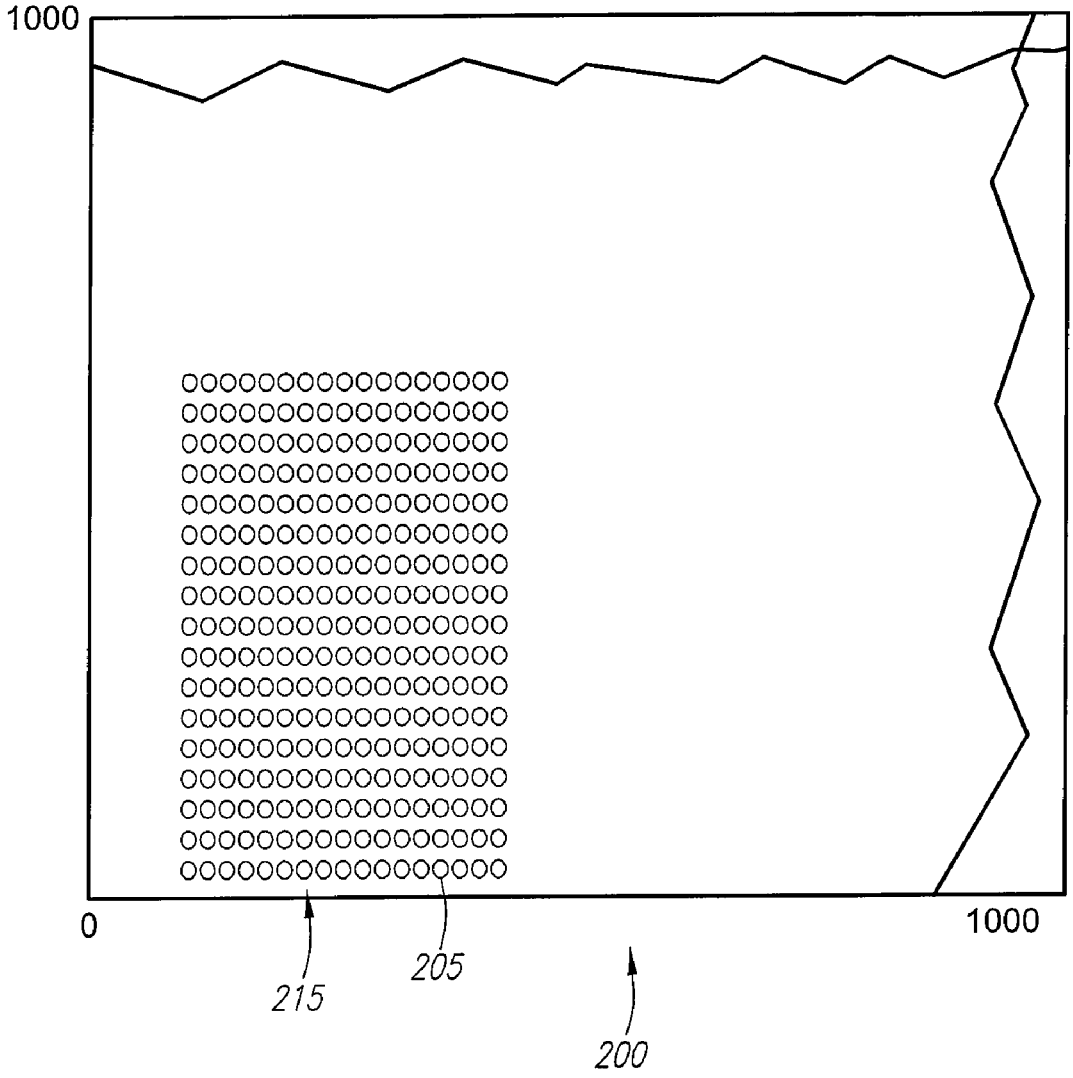
FIG. 9 a schematic representation of a ROI within the CMOS sensor array.

As the golf club 33 tracks through the field of view 100, the CMOS sensor array 200 creates new ROIs that encompass the reflective dots 106*a-c*. As shown in FIG. 8, the golf club 33 (shown by the reflective dots 106*a-c*) has moved from its position in FIG. 7. As shown in FIG. 9, a second ROI 215 is established around the golf club 33. It is preferable to create an ROI having a minimum size since the frame rate is increased as the number of active pixels 205 is reduced. Some CMOS cameras only allow reduction in the number of columns, which would limit the frame rate.

Figure 10:
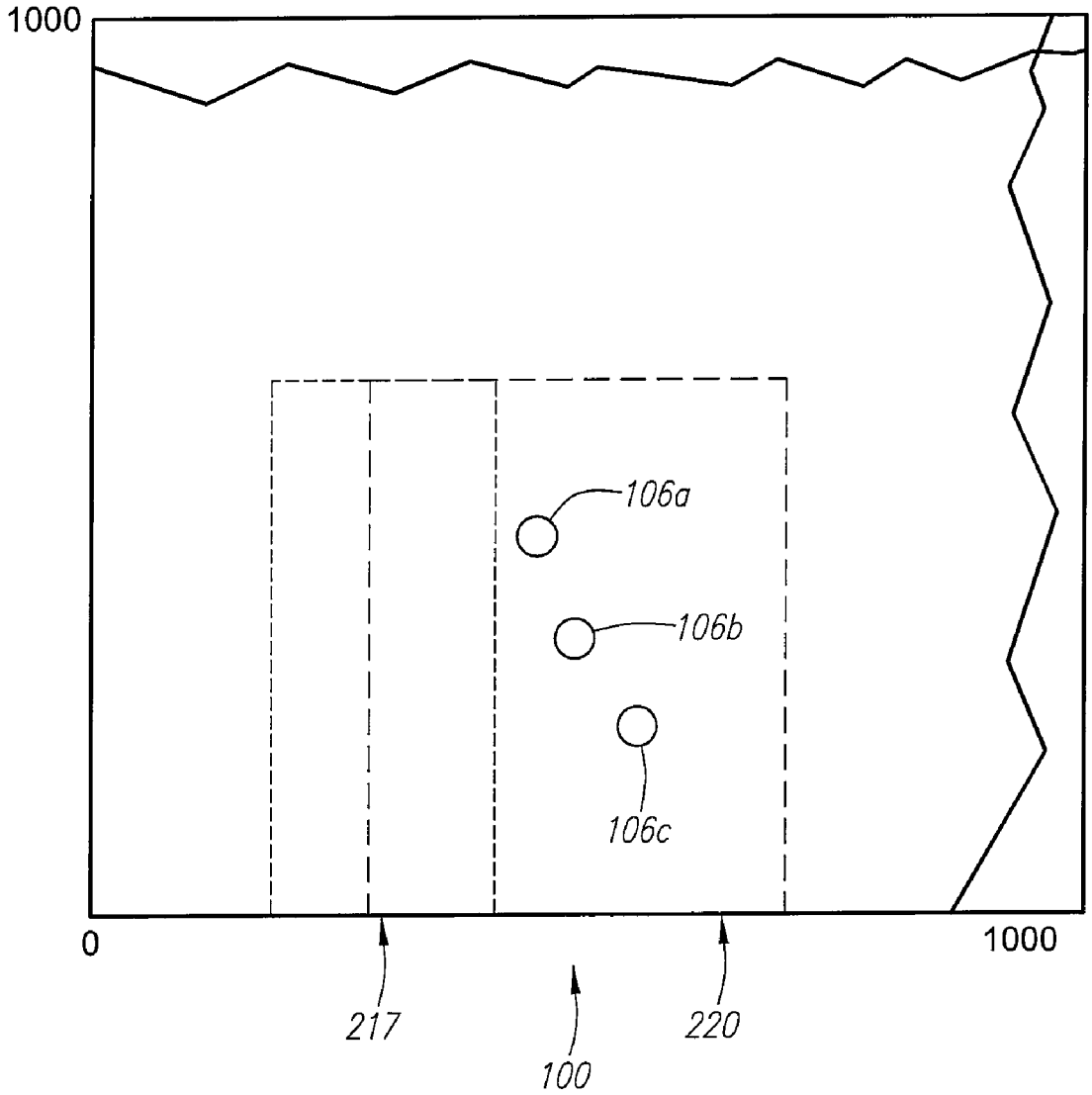
FIG. 10 a schematic representation of an object within the field of view.
Figure 11:
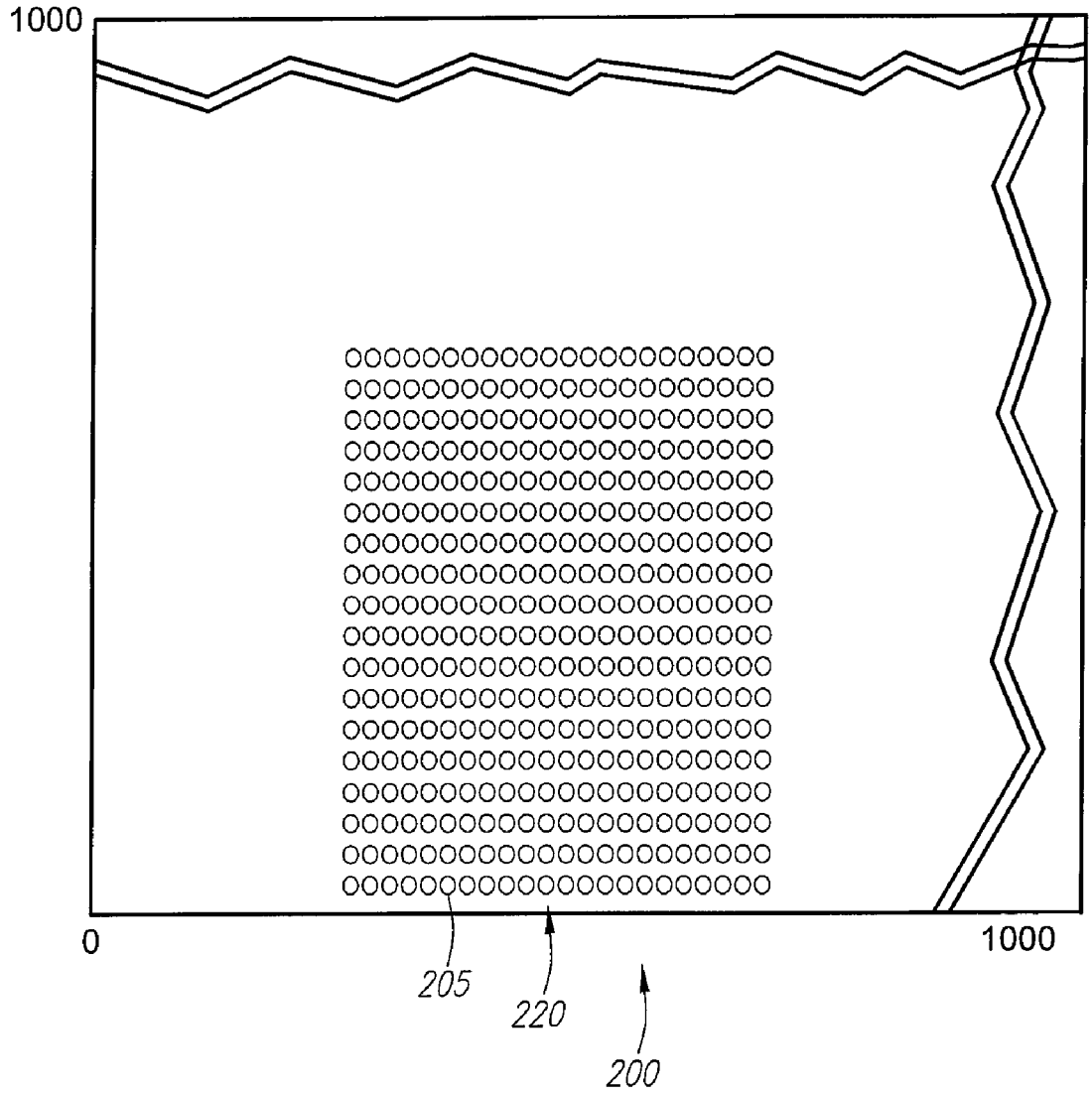
FIG. 11 a schematic representation of a ROI within the CMOS sensor array.

As the object or golf club 33 moves through the field of view 100, the current ROI preferably overlaps the previous ROI in order to better track the movement of the object or golf club 33. As shown in FIG. 10, the current ROI 220 (shown by bold dashed lines) overlaps the previous ROI 217 (shown by small dashed lines). FIG. 11 illustrates the CMOS sensor array 200 for ROI 220.

Figure 12:
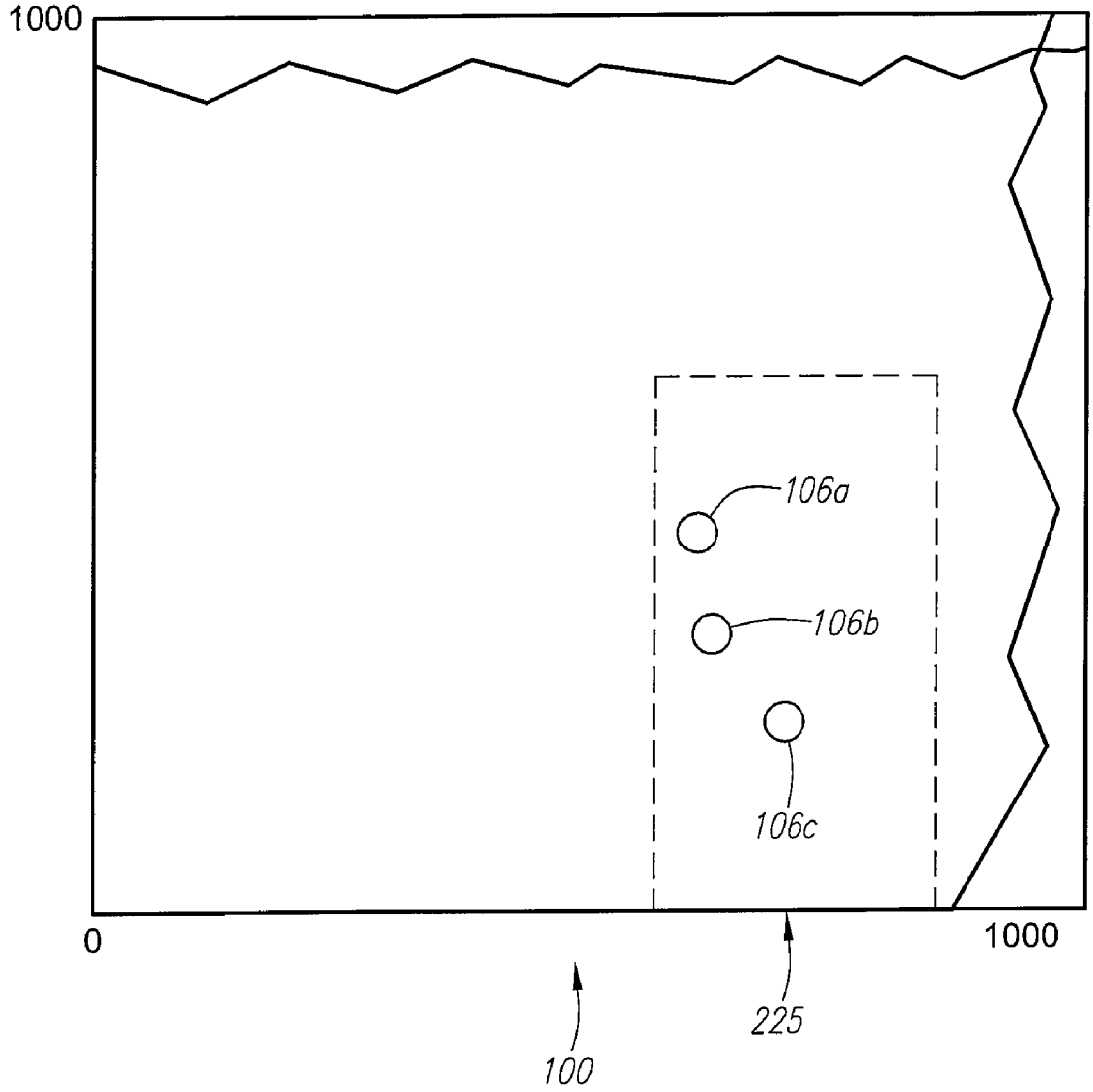
FIG. 12 a schematic representation of an object within the field of view.
Figure 13:
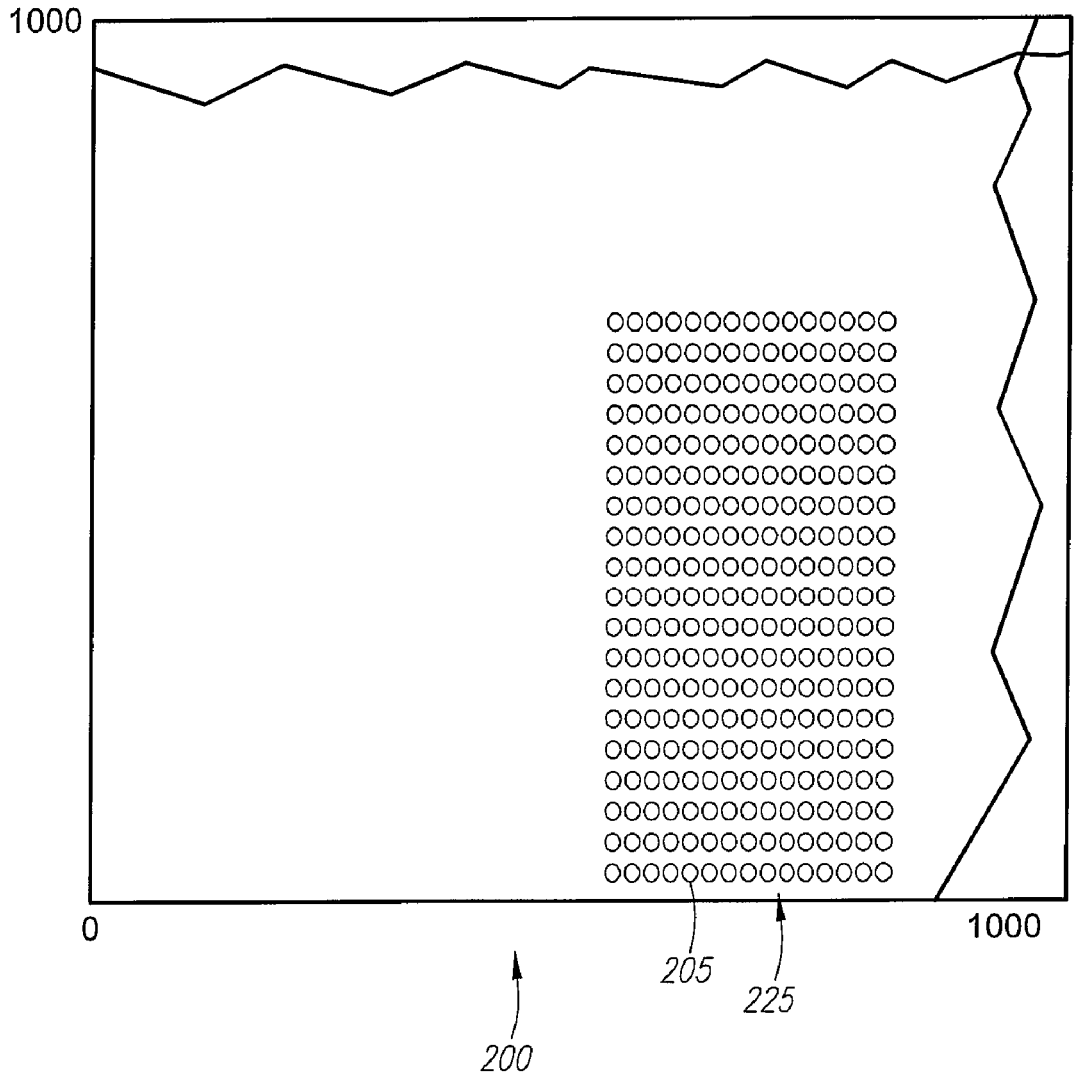
FIG. 13 a schematic representation of a ROI within the CMOS sensor array.

FIGS. 12 and 13 illustrate the continued movement of the object or golf club 33 through the field of view 100 and the new ROI 225 encompassing the current position of the golf club 33.

Figure 14:
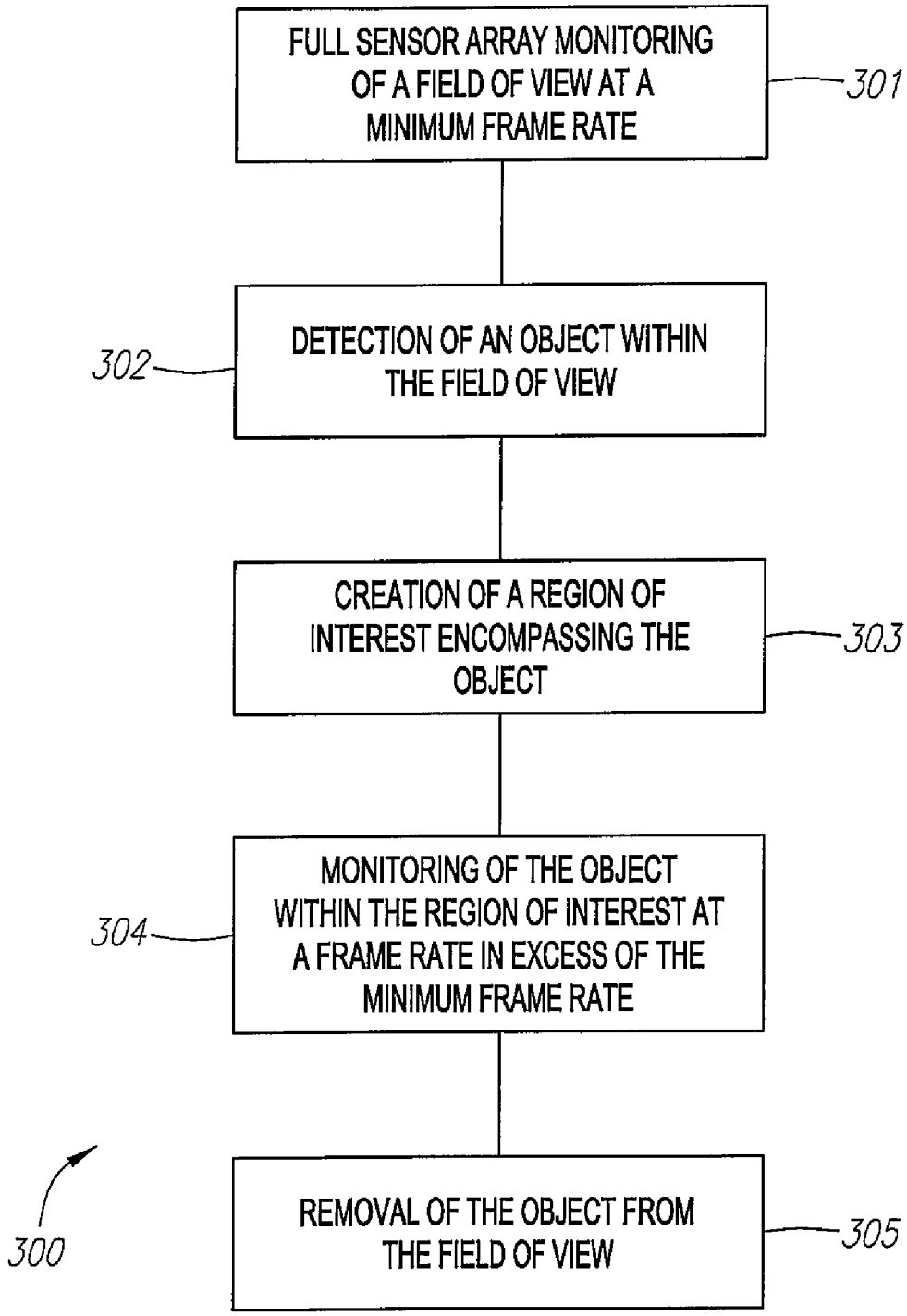
FIG. 14 is a flow chart of a method of using the system of the invention.

FIG. 14 is a flow chart of a method 300 of using the system 20 of the invention. At box 301, the full CMOS sensor array is active similar to FIG. 4. At box 302, an object such as a golf club 33 is detected within the field of view 100. If analyzing a golfer's swing, this first detection may be the golfer addressing the golf ball 32. During this address of the golf ball, the system 20 may be gathering information concerning the orientation of the club head to the golf ball as the golfer adjusts the position of the golf club to strike the golf ball. The CMOS sensor array 200 is operating at a minimum frame rate since all of the active pixels 205 are activated. However, since the movement of the golf club 33 is slow, this minimum frame rate is sufficient to gather the necessary information.

At box 303, a ROI is created around the object. At box 304, the objected is monitored at a higher frame rate. At box 305, the object is removed from the field of view. If the golf club 33 is monitored during address at box 304, increased information is provided until the golf club is taken away for a swing. Alternatively, if a golf ball 32 is monitored as the object at different time periods such as prior to impact, impact and post impact, then the ROI is created around the golf ball 32 until it leaves the field of view 100. Such monitoring is as discussed above in reference to the golf club.

Figure 15:
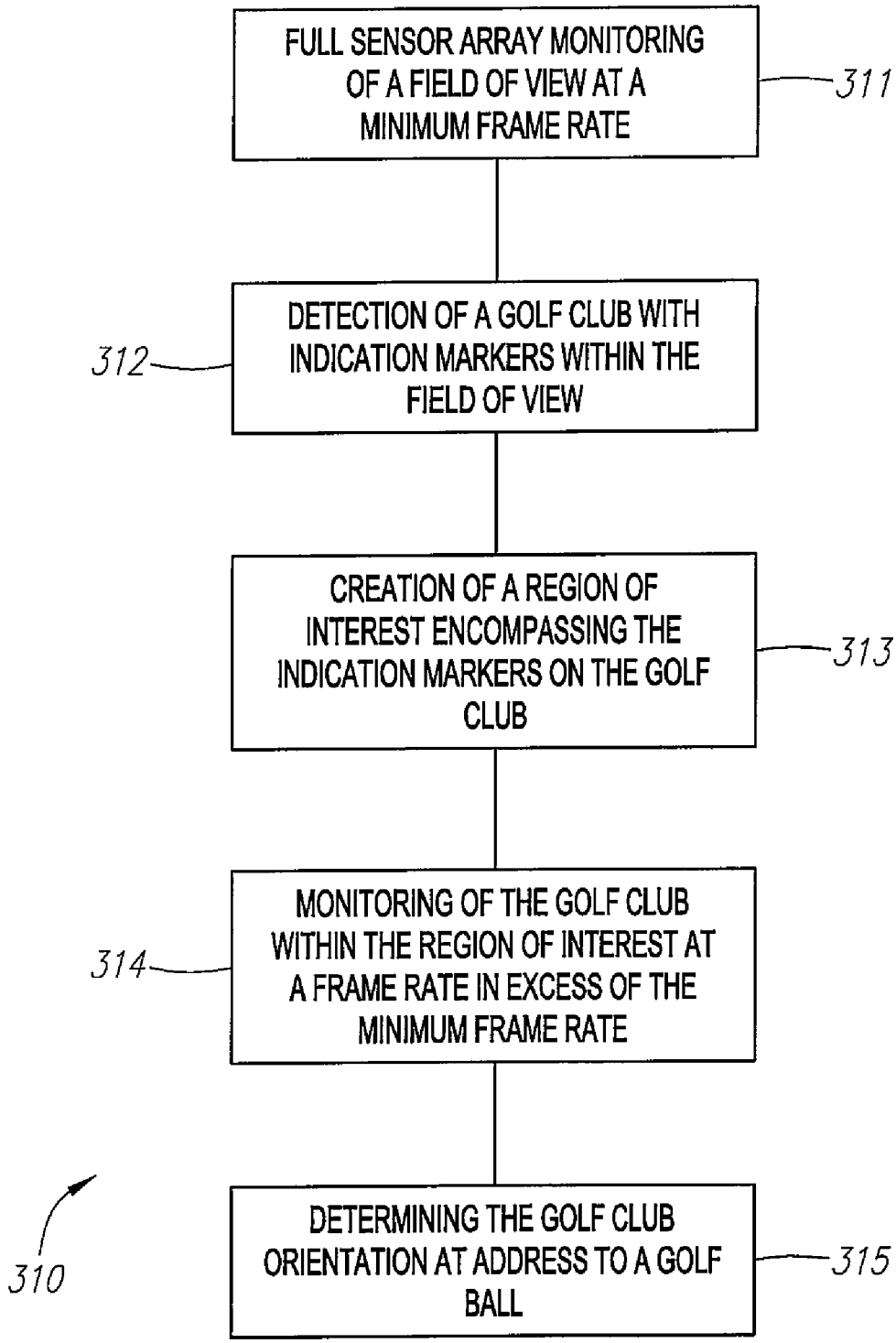
FIG. 15 is a flow chart of a method of using the system of the invention.

FIG. 15 is a flow chart of a specific method 310 for analysis of a golf club at address. At box 311, the CMOS sensor array monitors the field of view 100 at a minimum frame rate. At box 312, the indication markers (reflective dots or other like markers) on the golf club 33 are detected within the field of view 100. At box 313, a ROI is created around the indication markers of the golf club 33. At box 314, the golf club 33 is monitored at a higher frame rate within the ROI. At box 315, the golf club 33 is taken away from the field of view 100.

Figure 16:
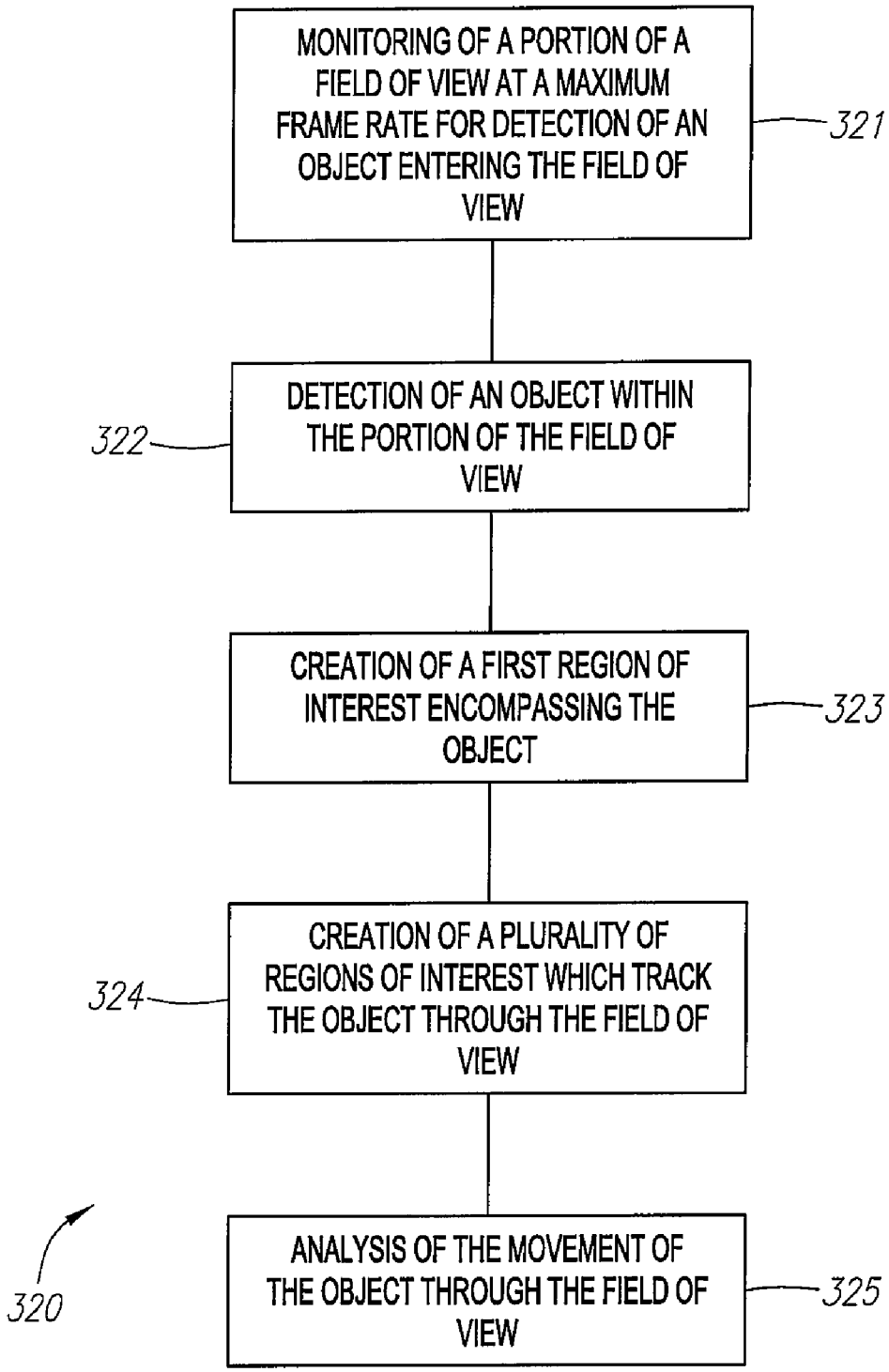
FIG. 16 is a flow chart of a method of using the system of the invention.

FIG. 16 is a method 320 for using the system 20 to monitor an object. At box 321, a portion of the field of view 100 is monitored at a maximum rate, similar to the ROI 210 established and monitored in FIG. 6. At box 322, an object is detected within the ROI. At box 323, a first ROI is created around the object. At box 324, a plurality of ROIs is created around the object as it tracks through the field of view 100. At box 325, information is provided on the movement of the object through the field of view.

Figure 17:
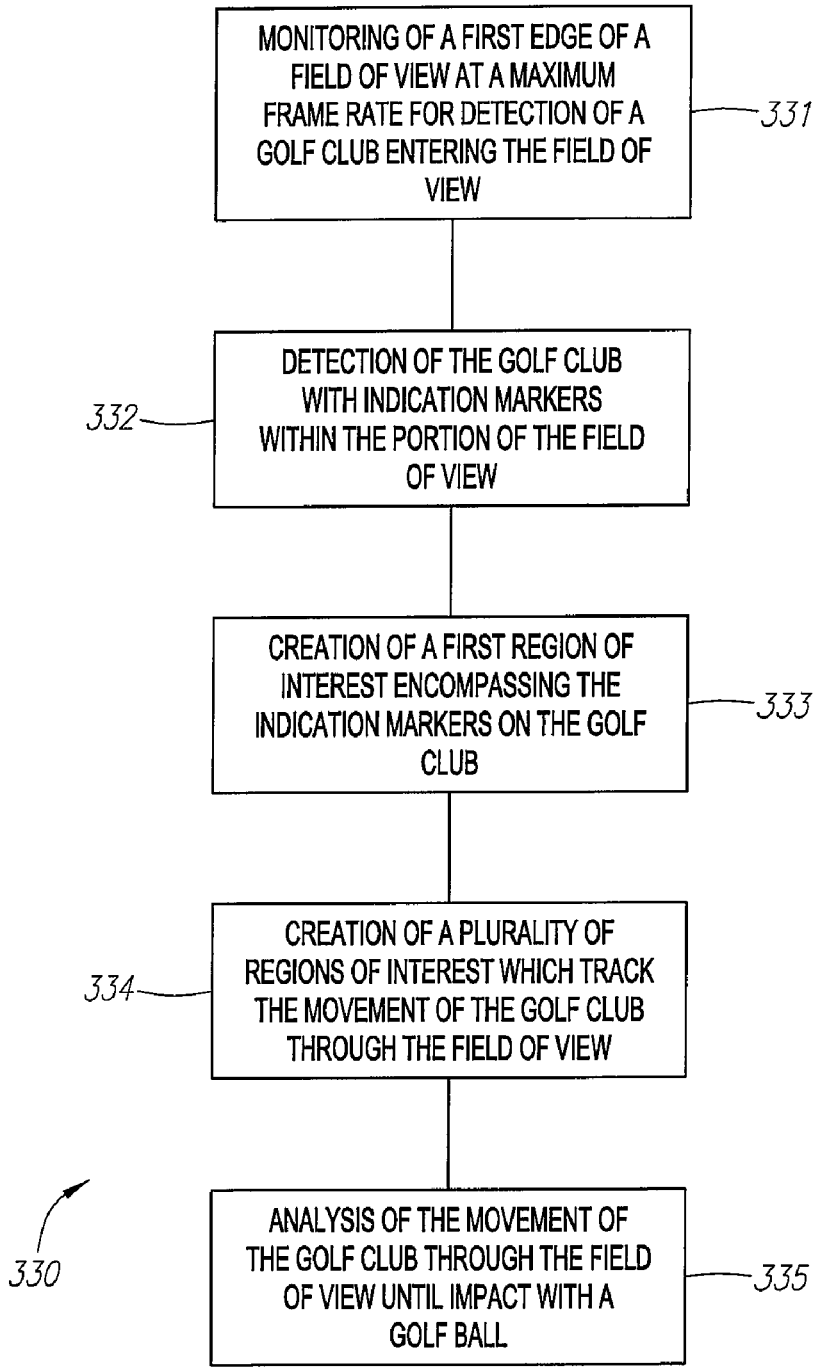
FIG. 17 is a flow chart of a method of using the system of the invention.

FIG. 17 is a flow chart of a method 330 for using the system to monitor a golf club. At box 331, a portion of the field of view 100 is monitored at a maximum rate, similar to the ROI 210 established and monitored in FIG. 6. At box 332, a golf club 33, or more specifically the indication markers of the golf club 33, is detected within the ROI. At box 333, a first ROI is created around the indications markers on the golf club 33. At box 334, a plurality of ROIs is created around the indication markers as the golf club tracks through the field of view 100. At box 335, information is provided on the movement of the golf club through the field of view to determine the swing properties of the golfer.

Figure 18:
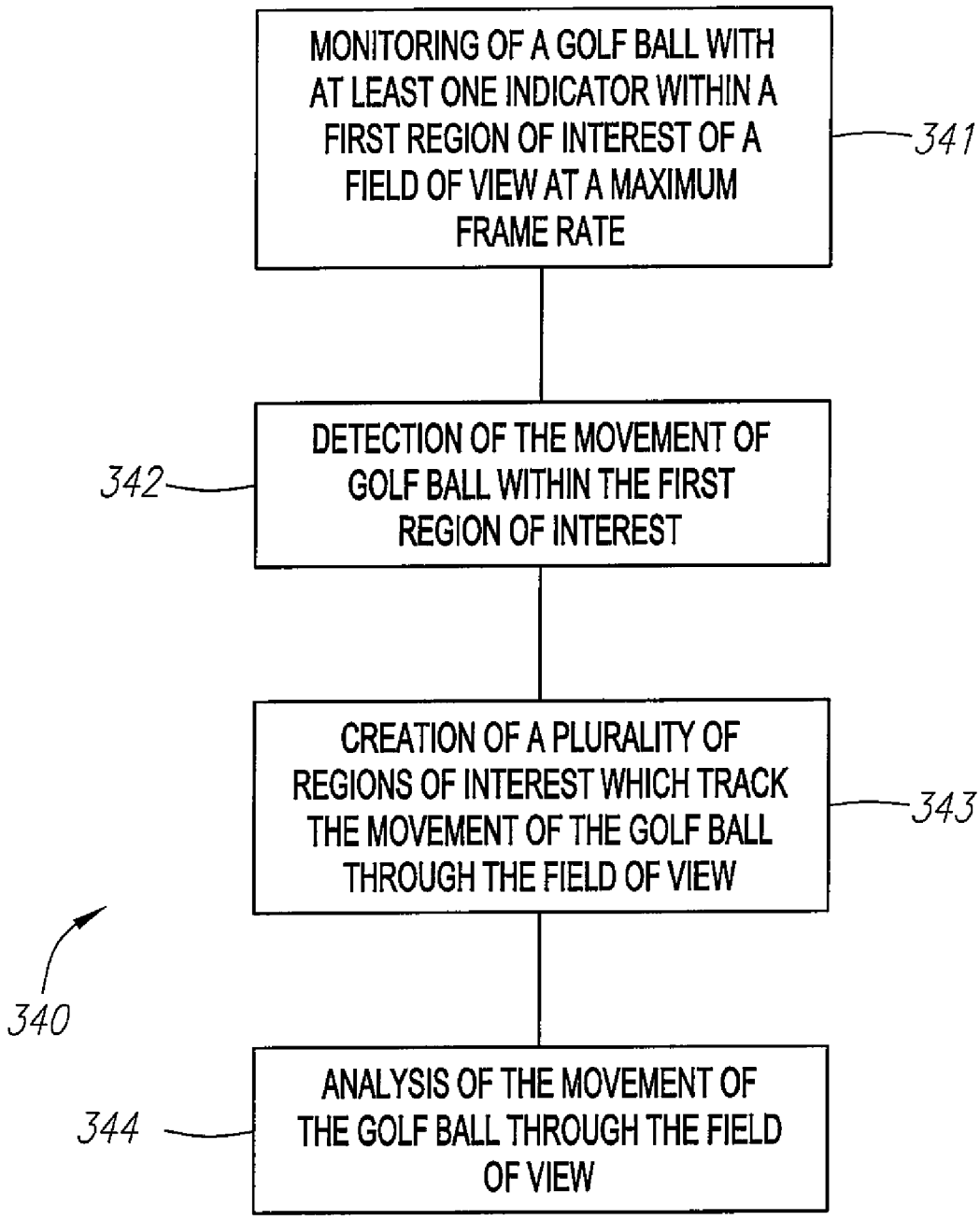
FIG. 18 is a flow chart of a method of using the system of the invention.

FIG. 18 is a flow chart of a method 340 for using the system to monitor a golf ball during launch. At box 341, an ROI is created around the golf ball prior to impact with a golf club. At box 342, movement of the golf ball 32 is detected by the system 20. At box 343, a plurality of ROIs is created around the golf ball during the initial launch of the golf ball subsequent to impact with a golf club. At box 344, the system analyzes the movement of the golf ball to provide launch parameters of the golf ball 32.

The CMOS sensor array 200 can operate at frames rates 4000 frames per second for a very small ROI. However, processing time between images or frames requires preferably less than 500 microseconds, and preferably less than 250 microseconds. The processing time is needed to analyze the image to determine if an object is detected and if the object is moving.

The system 20 may be calibrated using many techniques known to those skilled in the pertinent art. One such technique is disclosed in U.S. Pat. No. 5,803,823 which is hereby incorporated by reference. The system 20 is calibrated when first activated, and then may operate to analyze golf swings for golfers until deactivated.

As mentioned above, the system 20 captures and analyzes golf club information and golf ball information during and after a golfer's swing. The system 20 uses the images and other information to generate the information on the golfer's swing. The golf club 33 has at least two, but preferably three highly reflective points 106*a-c* preferably positioned on the shaft, heel and toe of the golf club 33. The highly reflective points 106*a-c* may be inherent with the golf club design, or each may be composed of a highly reflective material that is adhesively attached to the desired positions of the golf club 33. The points 106*a-c* are preferably highly reflective since the cameras 40 and 44 are preferably programmed to search for two or three points that have a certain brightness such as 200 out of a gray scale of 0-255. The cameras 40 and 44 search for point pairs that have approximately one inch separation, and in this manner, the detection of the golf club 33 is acquired by the cameras for data acquisition.

Figure 19:
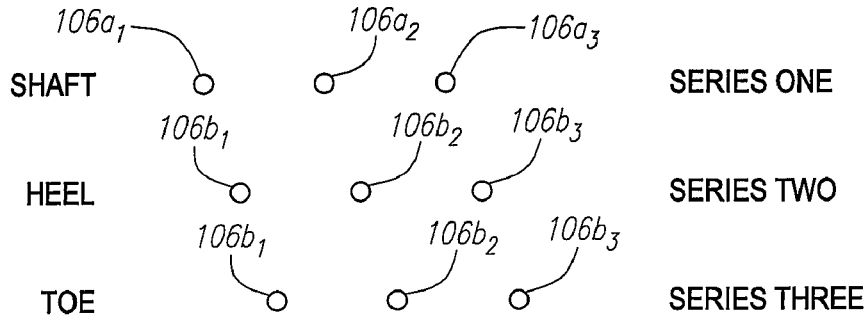
FIG. 19 is a schematic representation of the highly reflective points of the golf club positioned in accordance with the first, second and third exposures of the golf club.

As shown in FIG. 19, the first row of acquired highly reflective points 106*a* (on the shaft) is designated series one, the second row of acquired highly reflective points 106*b* (on the heel) is designated series two, and the third row of acquired highly reflective points 106*c* (on the toe) is designated series three. The first row is the acquired highly reflective points 106*a* from the shaft, the second row is the acquired highly reflective points 106*a* from the heel, and the third row is the acquired highly reflective points 106*a* from the toe. The following equation is used to acquire the positioning information:

$$d=[(Ptx-Pnx)^2+(Pty-Ptny)^2 \ldots]^{1/2}$$

where d is the distance, Ptx is the position in the x direction and Pty is the position in the y direction.

The system 20 may use a three point mode or a two point mode to generate further information. The two point mode uses $V_{toe}$, $V_{heel}$ and $V_{clubtop}$ to calculate the head speed.

$$V_{toe}=[(Ptx_3-Ptx_1)^2+(Pty_3-Pty_1)^2+(Ptz_3-Ptz_1)^2]^{1/2}[1/\delta T]$$

$$V_{heel}=[(Ptx_3-Ptx_1)^2+(Pty_3-Pty_1)^2+(Ptz_3-Ptz_1)^2]^{1/2}[1/\delta T]$$

$$V_{clubtop}=[V_{toe}+V_{heel}][1/2]$$

$$Vy=[(y_{3heel}-y_{1heel})^2+(y_{3toe}-y_{1toe})^2]^{1/2}[1/(2*\delta T)]$$

$$Vz=[(z_{3heel}-z_{1heel})^2+(z_{3toe}-z_{1toe})^2]^{1/2}[1/(2*\delta T)]$$

This information is then used to acquire the path angle and attack angle of the golf club 33. The Path angle=$\sin^{-1}(Vy/[V])$ where [V] is the magnitude of V.

The attack angle=$\sin^{-1}(Vz/[V])$, and the dynamic loft and dynamic lie are obtained by using Series one and Series two to project the loft and lie onto the vertical and horizontal planes.

The two point mode uses the shaft highly reflective point 106*a* or the toe highly reflective point 106*c* along with the heel highly reflective point 106*b* to calculate the head speed of the golf club, the path angle and the attack angle. Using the shaft highly reflective point 106*a*, the equations are:

$$V_{heel}=[(Ptx_3-Ptx_1)^2+(Pty_3-Pty_1)^2+(Ptz_3-Ptz_1)^2]^{1/2}[1/\delta T]$$

$$V_{shaft}=[(Ptx_3-Ptx_1)^2+(Pty_3-Pty_1)^2+(Ptz_3-Ptz_1)^2]^{1/2}[1/\delta T]$$

$$V_{center}=1.02*(V_{shaft}+V_{heel})$$

$$Vy=[(y_{3heel}-y_{1heel})^2+(y_{3shaft}-y_{1shaft})^2]^{1/2}[1/(2*\delta T)]$$

$$Vz=[(z_{3heel}-z_{1heel})^2+(z_{3shaft}-z_{1shaft})^2]^{1/2}[1/(2*\delta T)]$$

The Path angle=$\sin^{-1}$(Vy/[V]) where [V] is the magnitude of *V*.

The attack angle=$\sin^{-1}$(Vz/[V]).

Using the toe highly reflective point 106*c*, the equations are:

$$V_{toe}=[(x_3-x_1)^2+(y_3-y_1)^2+(z_3-z_1)^2]^{1/2}[1/\delta T]$$

$$V_{heel}=[(x_2-x_1)^2+(y_2-y_1)^2+(z_2-z_1)^2]^{1/2}[1/\delta T]$$

$$V_{clubtop}=[V_{toe}+V_{heel}][1/2]$$

The path angle=$\sin^{-1}(Vy_{clubtop}/[V_{clubtop}])$ where $[V_{clubtop}]$ is the magnitude of $V_{clubtop}$.

The attack angle=$\sin^{-1}(Vz_{clubtop}/[V_{clubtop}])$ where $[V_{clubtop}]$ is the magnitude of $V_{clubtop}$.

The golf ball 32 information is mostly obtained from images of the golf ball post impact. First, the best radius and position of the two dimensional areas of interest are determined from the images. Next, all of the combinations of the golf ball 32 centers in the images are matched and passed through a calibration model to obtain the X, Y, and Z coordinates of the golf ball 32. The system 20 removes the pairs with an error value greater then 5 millimeters to get acceptable X, Y, Z coordinates. Next, the strobe times from the flash units 42*a-b* and 46*a-b* are matched to the position of the golf ball 32 based on the estimated distance traveled from the images. Next, the velocity of the golf ball 32 is obtained from Vx, Vy and Vz using a linear approximation. Next the golf ball speed is obtained by calculating the magnitude of Vx, Vy and Vz.

The launch angle=$\sin^{-1}$(Vz/golf ball speed), and the spin angle=$\sin^{-1}$(Vy/golf ball speed).

Figure 20:
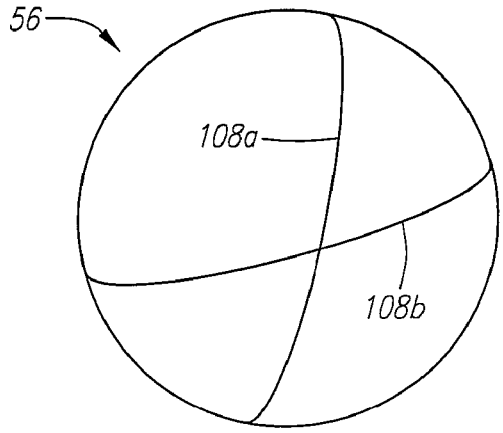
FIG. 20 is an isolated view of a golf ball striped for measurement.
Figure 20A:
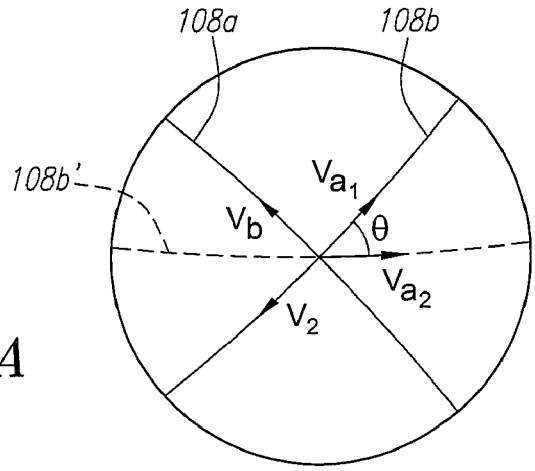
FIG. 20A is an isolated view of a golf ball striped for measurement using an image with a partial phantom of a prior image with vector signs present to demonstrate calculation of angle θ.

Next, the system 20 looks for the stripes 108*a-b*, as shown in FIGS. 20 and 20A, on the golf ball 32 by using a random transformation searching for the spot of greatest contrast. X, Y and Z coordinates are used with the arc of stripe 108*a* and the arc of stripe 108*b* to orient the arc on the golf ball. Then, the system 20 determines which arc is most normal using $(x^2+y^2)^{1/2}$.

Next, the θ angle of the golf ball 32 is measured by taking the first vector and the second vector and using the equation:

$$\theta=\cos^{-1}[(\text{vector } A1)(\text{vector } A2)]/([V_1][V_2])$$

where $[V_1]$ is the magnitude of $V_1$ and $[V_2]$ is the magnitude of $V_2$.

As the golf ball 32 rotates from the position shown in FIG. 20 to the position shown in FIG. 20A, the angle θ is determined from the position of vector A at both rotation positions. This allows for the spin to be determined. The back spin is calculated and applied to the first set of axis with a tilt axis of zero. The resultant vectors are compared to those of the next image and a theta is calculated for each of the vectors. This is done for each tilt axis until the Theta between the rotated first set of axis and the second set of axis is minimized.

The following is an example of how the system captures and analyzes golf club information and golf ball information during and after a golfer's swing. The golf club information includes golf club head orientation, golf club head velocity, and golf club spin. The golf club head orientation includes dynamic lie, loft and face angle of the golf club head. The golf club head velocity includes path of the golf club head, attack of the golf club head and downrange information. The golf ball information includes golf ball velocity, golf ball launch angle, golf ball side angle, golf ball speed manipulation and golf ball orientation. The golf ball orientation includes the true spin of the golf ball, and the tilt axis of the golf ball which entails the back spin and the side spin of the golf ball.

Figure 21:
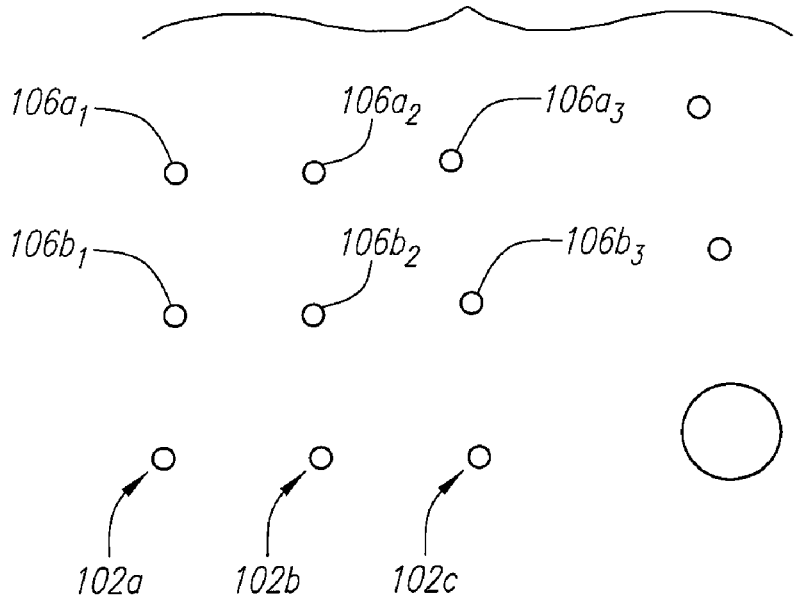
FIG. 21 illustrates first, second and third images of the connected highly reflective points on a golf club, and the teed golf ball for the first find grouping of the highly reflective points.
Figure 21A:
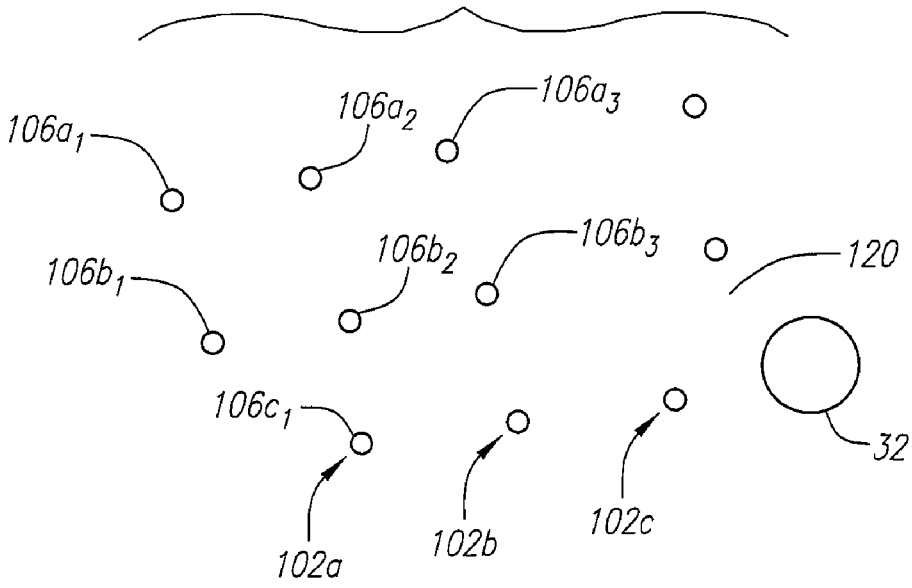
FIG. 21A illustrates first, second and third images of the connected highly reflective points on a golf club, and the teed golf ball for the first find grouping of the highly reflective points.
Figure 22:
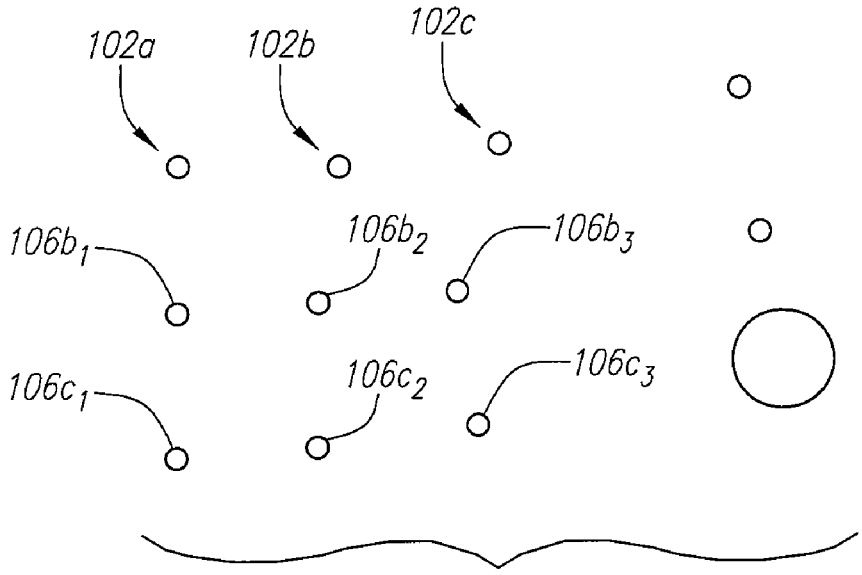
FIG. 22 illustrates first, second and third images of the connected highly reflective points on a golf club, and the teed golf ball for the second find grouping of the highly reflective points.
Figure 23:
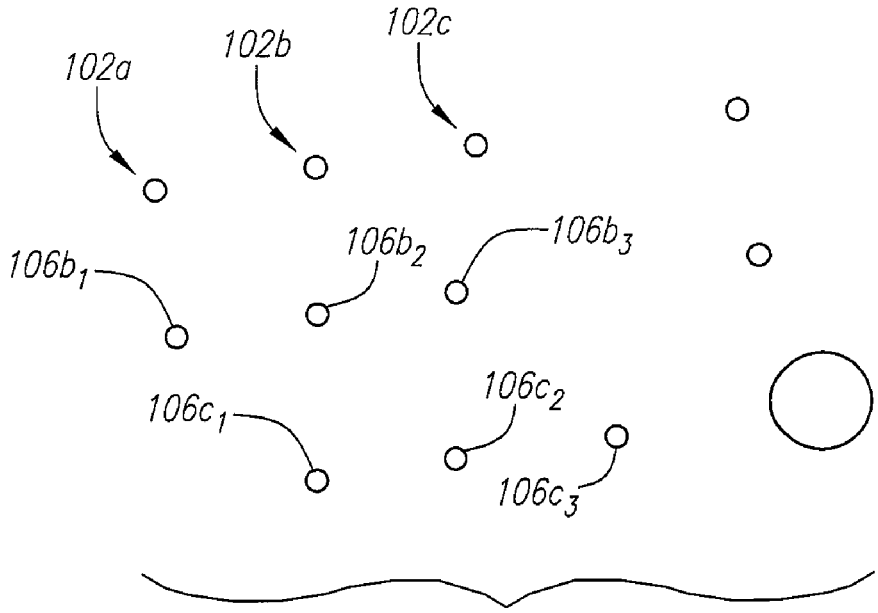
FIG. 23 illustrates first, second and third images of the connected highly reflective points on a golf club, and the teed golf ball for the second find grouping of the highly reflective points.
Figure 24:
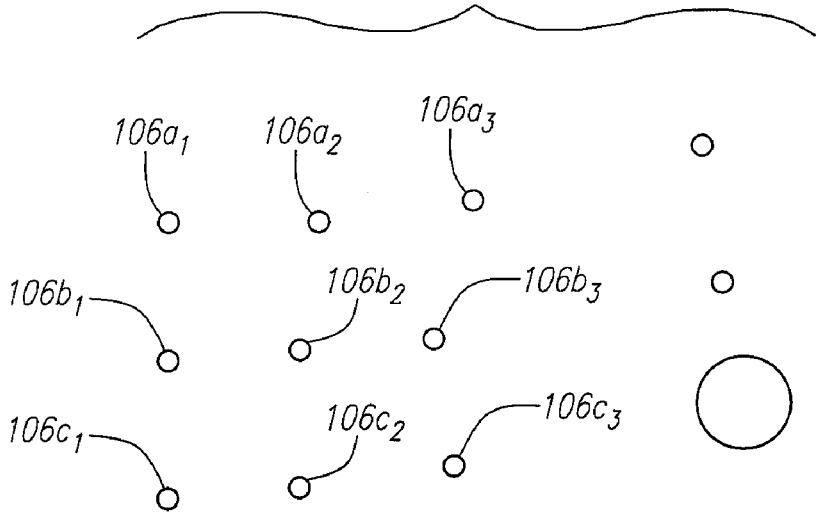
FIG. 24 illustrates first, second and third images of the connected highly reflective points on a golf club, and the teed golf ball with repeated points eliminated and results of the find displayed.
Figure 25:
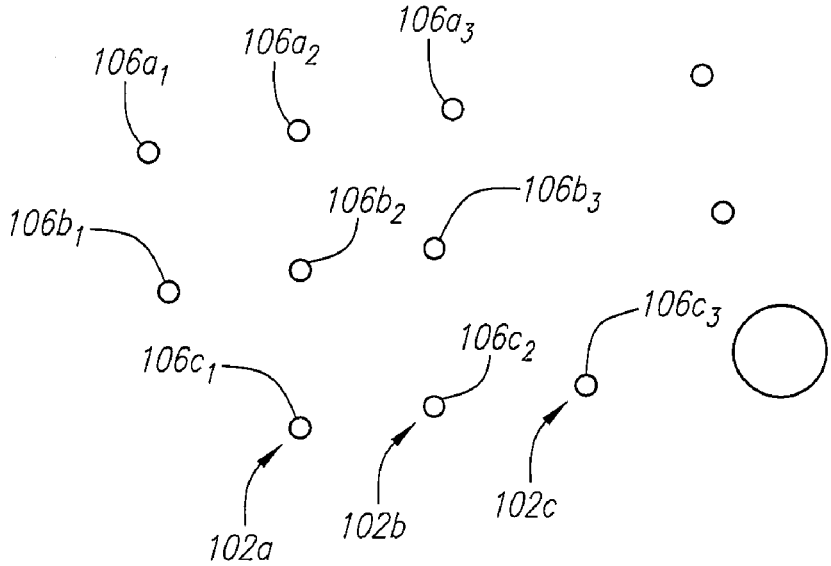
FIG. 25 illustrates first, second and third images of the connected highly reflective points on a golf club, and the teed golf ball with repeated points eliminated and results of the find displayed.
Figures 26, 27:
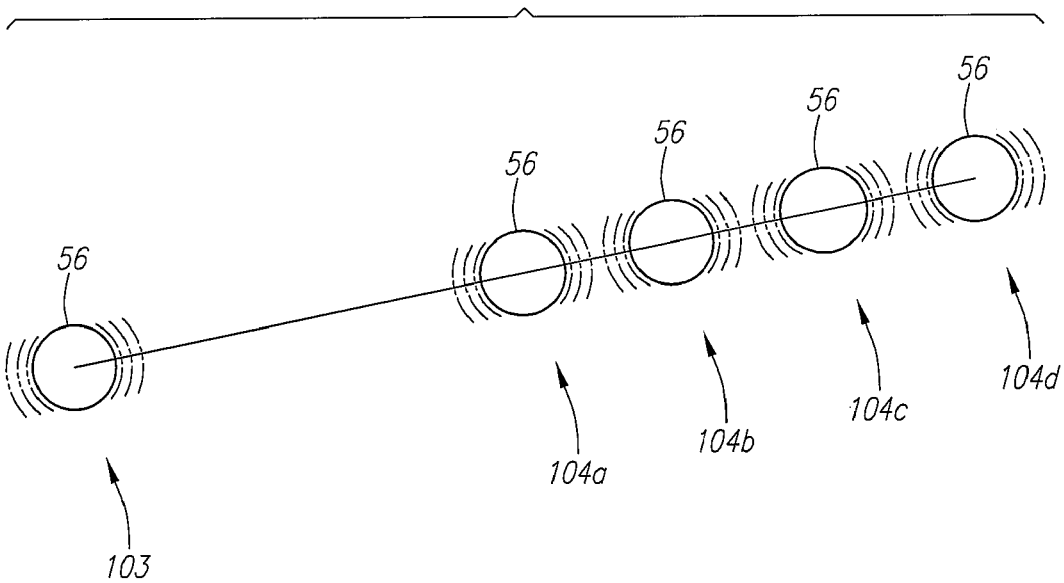
FIG. 26 is a chart of the processed final pairs giving the x, y and z coordinates.
FIG. 27 is an illustration of the thresholding of the images for the golf ball in flight.

The system 20 pairs the points 106*a-c*, verifying size, separation, orientation and attack angle. Then, the system 20 captures a set of six points (three pairs) from a first find as shown in FIGS. 21 and 21A. Then, the system 20 searches above and below the three pairs for a second find, as shown in FIGS. 22 and 23. The repeated points 106 are eliminated and the results are displayed from the find, as shown in FIGS. 24 and 25. The points of the final pairs are processed by the computer 22 and displayed as shown in FIG. 26.

Next the speed of the head of the golf club 33 is determined by the system 20 using the equations discussed above.

Next the path angle and the attack angle of the golf club 33 is determined by the system 20. Using the methods previously described, the attack angle is determined from the following equation:

$$\text{Attack angle}=-a\tan(\delta z/\delta x)$$

Where δz is the z value of the midpoint between $\mathbf{106}a_1$ and $\mathbf{106}b_1$ minus the z value of the midpoint between $\mathbf{106}a_3$ and $\mathbf{106}b_3$. Where δx is the x value of the midpoint between $\mathbf{106}a_1$ and $\mathbf{106}b_1$ minus the x value of the midpoint between $\mathbf{106}a_3$ and $\mathbf{106}b_3$.

The path angle is determined from the following equation:

$$\text{path angle}=-a\tan(\delta y/\delta x)$$

where δy is the y value of the midpoint between $\mathbf{106}a_1$ and $\mathbf{106}b_1$ minus the y value of the midpoint between $\mathbf{106}a_3$ and $\mathbf{106}b_3$. Where δx is the x value of the midpoint between $\mathbf{106}a_1$ and $\mathbf{106}b_1$ minus the x value of the midpoint between $\mathbf{106}a_3$ and $\mathbf{106}b_3$.

Figure 28:
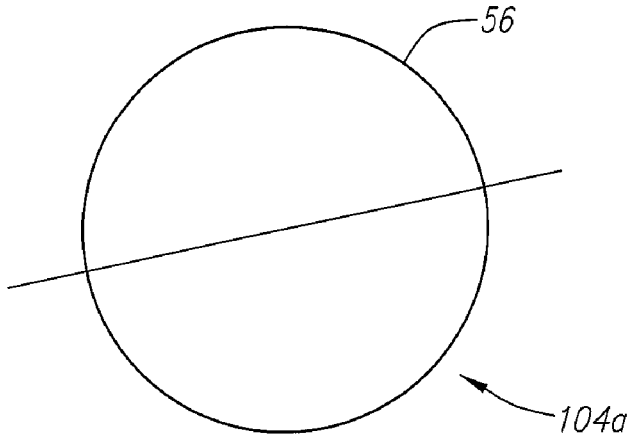
FIG. 28 is an isolated view of the golf ball to illustrate determining the best ball center and radius.
Figure 29:
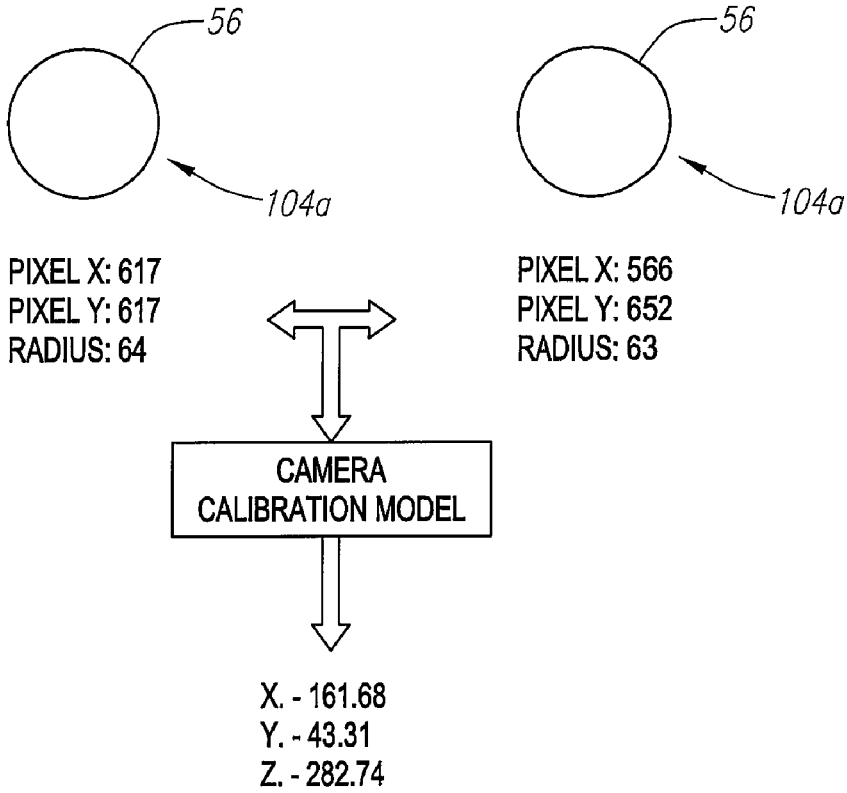
FIG. 29 is a partial flow chart with images of golf balls for stereo correlating two dimensional points.

Next, the golf ball 32 data is determined b the system 20. First, the thresholding of the image is established as shown in FIG. 27, at a lower gray scale value, approximately 100 to 120, to detect the golf ball 32. Next, well-known edge detection methods are used to obtain the best golf ball 32 center and radius, as shown in FIG. 28. Next, the stereo correlation of two dimensional points on the golf ball 32 is performed by the system 20 as in FIG. 29, which illustrates the images of the first camera 40 and the second camera 44.

Figure 30:
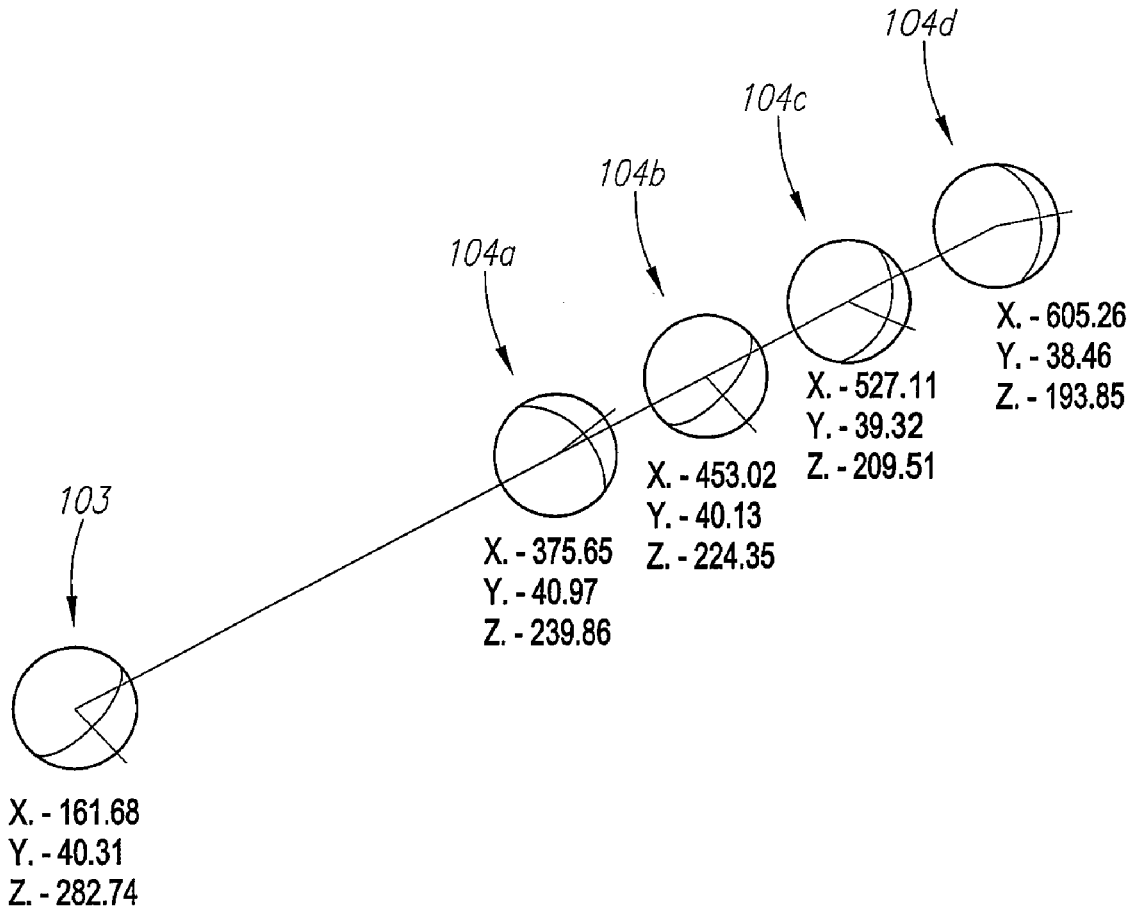
FIG. 30 illustrates the teed golf ball and the first, second third and fourth images of the golf ball after impact, along with positioning information.

Next, as shown in FIG. 30, with the positioning information provided therein, the speed of the golf ball 56, the launch angle of the golf ball 32, and the side angle of the golf ball 32 is determined by the system 20. The speed of the golf ball is determined by the following equation:

Golf ball speed=$[\delta X^2+\delta y^2+\delta Z^2]^{1/2}/\delta T$. For the information provided in FIG. 30, the speed of the golf ball= $[(-161.68+(-605.26))^2+(-43.41+(-38.46))^2+(-282.74+(-193.85))^2]^{1/2}/(13127-5115)$, which is equal to 126 MPH once converted from millimeters over microseconds.

The launch angle of the golf ball 32 is determined by the following equation: Launch angle=$\sin^{-1}$(Vz/golf ball speed) where Vz=δZ/δT.

For the information provided in FIG. 30, Vz=[(−282.74+(−193.85))]/(13127−5115)=11.3 MPH. Then, the launch angle=$\sin^{-1}$(1.3/126.3)=11.3 degrees.

The side angle of the golf ball 32 is determined by the following equation: Side angle=$\sin^{-1}$(Vy/golf ball speed)

where Vy=δY/δT. For the information provided in FIG. 30, Vy=[(−43.41+(−38.46)]/(13127−5115)=1.4 MPH.

Then, the side angle=$\sin^{-1}(1.4/126.3)$=0.6 degrees.

The ball spin is calculated by determining the location of the three striped on each of the acquired golf balls. Matching each axis in the field of view and determine which of the axis is orthogonal to the vertical plane. The spin is then calculated by:

θ=a cos((vector A1 dot vector A2)/mag(v1)*mag(v2)) as discussed above.

Once the pre-impact swing properties are determined (calculated), the rigid body code is used to predict the ball launch parameters. The rigid body code solves the impact problem using conservation of linear and angular momentum, which gives the complete motion of the two rigid bodies. The impulses are calculated using the definition of impulse, and the equations are set forth below. The coordinate system used for the impulse equations is set forth below. The impulse-momentum method does not take in account the time history of the impact event. The collision is described at only the instant before contact and the instant after contact. The force transmitted from the club head to the ball is equal and opposite to the force transmitted from the ball to the club head. These forces are conveniently summed up over the period of time in which the two objects are in contact, and they are called the linear and angular impulses.

The present invention assumes that both the golf ball 66 and the golf club head 50 are unconstrained rigid bodies, even though the golf club head 50 is obviously connected to the shaft 52, and the ball 66 is not floating in air upon impact with the golf club head 50. For the golf club head 50, the assumption of an unconstrained rigid body is that the impact with the golf ball 66 occurs within a very short time frame (microseconds), that only a small portion of the tip of the shaft 52 contributes to the impact. For the golf ball 66, the impulse due to friction between itself and the surface it is placed upon (e.g. tee, mat or ground) is very small in magnitude relative to the impulse due to the impact with the golf club head 50, and thus this friction is ignored in the calculations.

In addition to the normal coefficient of restitution, which governs the normal component of velocity during the impact, there are coefficients of restitution that govern the tangential components of velocity. The additional coefficients of restitution are determined experimentally.

The absolute performance numbers are defined in the global coordinate system, or the global frame. This coordinate system has the origin at the center of the golf ball, one axis points toward the intended final destination of the shot, one axis points straight up into the air, and the third axis is normal to both of the first two axis. The global coordinate system preferably follows the right hand rule.

The coordinate system used for the analysis is referred to as the impact coordinate system, or the impact frame. This frame is defined relative to the global frame for complete analysis of a golf shot. The impact frame is determined by the surface normal at the impact location on the golf club head 50. The positive z-direction is defined as the normal outward from the golf club head 50. The plane tangent to the point of impact contains both the x-axis and they-axis. For ease of calculation, the x-axis is arbitrarily chosen to be parallel to the global ground plane, and thus the yz-plane is normal to the ground plane. The impact frame incorporates the loft, bulge and roll of a club head, and also includes the net result of the golf swing. Dynamic loft, open or close to the face, and toe down all measured for definition of the impact frame. Motion in the impact frame is converted to equivalent motion in the global frame since the relationship between the global coordinate system and the impact coordinate system is known. The post impact motion of the golf ball 66 is used as inputs in the Trajectory Code, and the distance and deviation of the shot is calculated by the present invention.

The symbols are defined as below:

$\vec{i}$=(1 0 0), the unit vector in the x-direction.

$\vec{j}$=(0 1 0), the unit vector in the y-direction.

$\vec{k}$=(0 0 1), the unit vector in the z-direction.

$m_1$, the mass of the club head.

$m_2$, the mass of the golf ball.

$$[I]_1 = \begin{bmatrix} I_{xx,1} & -I_{xy,1} & -I_{xz,1} \\ -I_{xy,1} & I_{yy,1} & -I_{yz,1} \\ -I_{xz,1} & -I_{yz,1} & I_{zz,1} \end{bmatrix},$$

the inertia tensor of the club head.

$$[I]_2 = \begin{bmatrix} I_{xx,2} & -I_{xy,2} & -I_{xz,2} \\ -I_{xy,2} & I_{yy,2} & -I_{yz,2} \\ -I_{xz,2} & -I_{yz,2} & I_{zz,2} \end{bmatrix},$$

the inertia tensor of the golf ball.

$\vec{r}$=($a_1$ $b_1$ $c_1$), the vector from point of impact to the center of gravity of the club head.

$\vec{r}_2$=($a_2$ $b_2$ $c_2$), the vector from point of impact to the center of gravity of the golf ball.

$\vec{r}_3=-\vec{r}_1+\vec{r}_2$=($-a_1+a_2$ $-b_1+b_2$ $-c_1+c_2$)=($a_3$ $b_3$ $c_3$), the vector from center of gravity of club head to the center of gravity of the golf ball.

$\vec{v}_{1,i}$=($v_{x,1,i}$ $v_{y,1,i}$ $v_{z,1,i}$), the velocity of the club head before impact.

$\vec{v}_{1,f}$=($v_{x,1,f}$ $v_{y,1,f}$ $v_{z,1,f}$), the velocity of the club head after impact.

$\vec{v}_{1,i}$=($v_{x,1,i}$ $v_{y,1,i}$ $v_{z,1,i}$), the velocity of the golf ball before impact.

$\vec{v}_{2,f}$=($v_{x,2,f}$ $v_{y,2,f}$ $v_{z,2,f}$), the velocity of the golf ball after impact.

$\vec{\omega}_{1,i}$=($\omega_{x,1,i}$ $\omega_{y,1,i}$ $\omega_{z,1,i}$), the angular velocity of the club head before impact.

$\vec{\omega}_{1,f}$=($\omega_{x,1,f}$ $\omega_{y,1,f}$ $\omega_{z,1,f}$), the angular velocity of the club head after impact.

$\vec{\omega}_{2,i}$=($\omega_{x,2,i}$ $\omega_{y,2,i}$ $\omega_{z,2,i}$), the angular velocity of the golf ball before impact.

$\vec{\omega}_{2,f}$=($\omega_{x,2,f}$ $\omega_{y,2,f}$ $\omega_{z,2,f}$), the angular velocity of the golf ball after impact.

$$[e] = \begin{bmatrix} e_{xx} & e_{xy} & e_{xz} \\ e_{xy} & e_{yy} & e_{yz} \\ e_{xz} & e_{yz} & e_{zz} \end{bmatrix},$$

the coefficient of restitution matrix.

$[L]=m\vec{v}$, definition of linear momentum.

$[H]=[I]\vec{\omega}$, definition of angular momentum.

Conservation of Linear Momentum:

$$m_1\vec{v}_{1,f}+m_2\vec{v}_{2,f}=m_1\vec{v}_{1,i}+m_2\vec{v}_{2,i} \quad \text{B1-B3}$$

Conservation of Angular Momentum:

$$[I]_1\vec{\omega}_{1,f}+[I]_2\vec{\omega}_{2,f}+m_1\begin{bmatrix}-c_1v_{y,1,f}+b_1v_{z,1,f}\\ c_1v_{x,1,f}-a_1v_{z,1,f}\\ a_1v_{y,1,f}-b_1v_{x,1,f}\end{bmatrix}+ \quad \text{B4-B6}$$

$$m_2\begin{bmatrix}-c_2v_{y,2,f}+b_2v_{z,2,f}\\ c_2v_{x,2,f}-a_2v_{z,2,f}\\ a_2v_{y,2,f}-b_2v_{x,2,f}\end{bmatrix}=[I]_1\vec{\omega}_{1,i}+[I]_2\vec{\omega}_{2,i}+$$

$$m_1\begin{bmatrix}-c_1v_{y,1,i}+b_1v_{z,1,i}\\ c_1v_{x,1,i}-a_1v_{z,1,i}\\ a_1v_{y,1,i}-b_1v_{x,1,i}\end{bmatrix}+m_2\begin{bmatrix}-c_2v_{y,2,i}+b_2v_{z,2,i}\\ c_2v_{x,2,i}-a_2v_{z,2,i}\\ a_2v_{y,2,i}-b_2v_{x,2,i}\end{bmatrix}$$

The Definition of Coefficients of Restitution:

$$-[e]\begin{bmatrix}\left(v_{x,2,i}+\vec{i}\cdot(\vec{\omega}_{2,i}\times(-\vec{r}_2))\right)-\left(v_{x,1,i}+\vec{i}\cdot(\vec{\omega}_{1,i}\times(-\vec{r}_1))\right)\\ \left(v_{y,2,i}+\vec{j}\cdot(\vec{\omega}_{2,i}\times(-\vec{r}_2))\right)-\left(v_{y,1,i}+\vec{j}\cdot(\vec{\omega}_{1,i}\times(-\vec{r}_1))\right)\\ \left(v_{z,2,i}+\vec{k}\cdot(\vec{\omega}_{2,i}\times(-\vec{r}_2))\right)-\left(v_{z,1,i}+\vec{k}\cdot(\vec{\omega}_{1,i}\times(-\vec{r}_1))\right)\end{bmatrix}= \quad \text{B7-B9}$$

$$\begin{bmatrix}\left(v_{x,2,f}+\vec{i}\cdot(\vec{\omega}_{2,f}\times(-\vec{r}_2))\right)-\left(v_{x,1,f}+\vec{i}\cdot(\vec{\omega}_{1,f}\times(-\vec{r}_1))\right)\\ \left(v_{y,2,f}+\vec{j}\cdot(\vec{\omega}_{2,f}\times(-\vec{r}_2))\right)-\left(v_{y,1,f}+\vec{j}\cdot(\vec{\omega}_{1,f}\times(-\vec{r}_1))\right)\\ \left(v_{z,2,f}+\vec{k}\cdot(\vec{\omega}_{2,f}\times(-\vec{r}_2))\right)-\left(v_{z,1,f}+\vec{k}\cdot(\vec{\omega}_{1,f}\times(-\vec{r}_1))\right)\end{bmatrix}$$

The Tangential Impulse on the Ball Causes Both Rotation and Translation:

$$m_2\begin{bmatrix}c_2(v_{y,2,f}-v_{y,2,i})-b_2(v_{z,2,f}-v_{z,2,i})\\ -c_2(v_{x,2,f}-v_{x,2,i})+a_2(v_{z,2,f}-v_{z,2,i})\\ b_2(v_{x,2,f}-v_{x,2,i})-a_2(v_{y,2,f}-v_{y,2,i})\end{bmatrix}=[I]_2\begin{bmatrix}\omega_{x,2,f}-\omega_{x,2,i}\\ \omega_{y,2,f}-\omega_{y,2,i}\\ \omega_{z,2,f}-\omega_{z,2,i}\end{bmatrix} \quad \text{B10-B12}$$

Equations B1-B12 can be combined to form a system of linear equations of the form:

$$[A]\{x\}=\{B\} \quad \text{B13}$$

where [A], and {B} are determined from the known velocities before the impact, the mass properties of the golf ball 66 and golf club head 50, the impact location relative to the center of gravity of the golf ball 66 and the golf club head 50, and the surface normal at the point of impact. {x} contains all the post impact velocities (linear and angular), and is solved by pre-multiplying {B} by the inverse of [A], or any other method in solving system of equations in linear algebra.

When the golf ball 66 is sitting on the tee 68, it is in equilibrium. The golf ball 66 will not move until a force that's greater than $F_m$, the maximum static friction force between the golf ball 66 and the tee 68, is applied on the golf ball 66.

$$F_m=\mu_sN=\mu_sm_2g \quad \text{C1}$$

$\mu_s$ is the static coefficient of friction and g is gravity.

For a golf ball 66 with 45 grams of mass, and a $\mu_s$ of 0.3, $$F_m=\mu_s mg=(0.3)(0.045)(9.81)=0.132N$$

Assume this force is applied on the golf ball 66 for the duration of an impact of 0.0005 sec (which is an overestimation of the actual impulse), then the impulse, L, on the golf ball 66 is:

$$L=(0.132)(0.0005)=0.0000662N\cdot s$$

This impulse, L, would cause the golf ball 66 to move at 0.00147 m/s (or 0.00483 ft/sec), and rotate at 8.08 rad/sec (or 77.1 rpm). Both of these numbers are small relative to the range of numbers normally seen for irons and woods. If the rigid body code of the present invention were to be applied to putters, then it would be preferable to include the friction force between the green and the golf ball 66 for the analysis.

$$[e]=\begin{bmatrix}e_{xx} & e_{xy} & e_{xz}\\ e_{xy} & e_{yy} & e_{yz}\\ e_{xz} & e_{yz} & e_{zz}\end{bmatrix}$$

Each of the individual terms in the above matrix, $e_{ij}$, where i=x, y, z, and j=x, y, z, relates the velocity in the i-direction to the j-direction. Each of the diagonal terms, where i=j, indicate the relationship in velocity of one of the axis, x, y, or z, before and after the impact. Let x, y, z be the axis defined in the impact frame. The term $e_{zz}$ includes all the energy that is lost in the impact in the normal direction of impact. $e_{xx}$ and $e_{yy}$ are account for the complicated interaction between the golf ball 66 and the golf club head 50 in the tangential plane by addressing the end result. In general, the off diagonal terms $e_{ij}$, where i≠j, are equal to zero for isotropic materials.

In predicting the performance of a golf ball struck by a golfer with a specific golf club under predetermined atmospheric conditions, an operator has the option of inputting an impact of the face at a certain location regardless of the true location of impact. This allows for prediction of the performance of the golf club 33 for toe shots, heel shots and center shots. The type of golf ball may be selected, the type of golf club may be selected, the atmospheric conditions including wind speed, direction, relative humidity, air pressure, temperature and the terrain may be selected by the operator to predict a golfer's performance using these input parameters along with the pre-impact swing properties for the golfer.

The method of the present invention for predicting the performance of two different golfers, using two different golf clubs, with two different golf balls under two different atmospheric conditions is illustrated in FIGS. 31-40. Golfer B has a higher swing speed than Golfer A. Golfers A and B swing a test club 10 times for an average of the swing of each golfer. The predicted performances are for a golf club head 50 composed of steel and a golf club head composed of titanium, a 2-piece golf ball with an ionomer blend cover and a three-piece (wound) golf ball with a balata cover, and atmospheric conditions of a warm day and a cold day.

FIG. 31 is a flow chart of the components of the pre-swing properties of block 204 of FIG. 1. The components or inputs include the image times at block 203.7, the measured points at block 203.8 and the static imaged points at block 203.9. FIG. 32 is a table of the image times (in microseconds) of block 203.7 for Golfer A and Golfer B. FIG. 33 is a table of the measured points (in millimeters) of block 203.8 for Golfer A and Golfer B. FIG. 34 is a table of the static image points (in millimeters) of block 203.9 for Golfer A and Golfer B.

FIG. 35 is a table of the golf club head properties of block 202 for golf club heads 50 composed of titanium (Ti) and steel. Blocks 401-404 of FIG. 1A are included along with optional hosel height and Spin COR inputs.

FIG. 36 is a table of the pre-impact swing properties of block 204 for each of the Golfers A and B. The table includes information for blocks 409-412 of FIG. 1C.

FIG. 37 is a table of the golf ball properties of block 206 with information for blocks 405-408 of FIG. 1B.

FIG. 38 is a table of the ball launch parameters of block 210 generated by the rigid body code. The table includes information for blocks 416-422 of FIG. 1D.

FIG. 39 is a table of the atmospheric conditions of block 214.

FIG. 40 is a table of the predicted performance of block 218 which is generated by the trajectory code. The table includes information for blocks 422-425 of FIG. 1E.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for predicting a golfer's ball striking performance, the method comprising:

providing a plurality of golf club head properties for a first golf club head of a first golf club;

providing a plurality of golf ball properties for a first golf ball;

determining a plurality of pre-impact swing properties for the golfer using at least one CMOS camera, the CMOS imaging system having a sensor array with at least one megapixel in size, wherein the CMOS imaging system forms a region of interest operating at a frame rate of 1000 to 4000 frames per second prior to the golf club entering the field of view and then forms subsequent regions of interest as the golf club travels through the field of view;

inputting the plurality of golf club properties, the plurality of golf ball properties and the plurality of pre-impact swing properties into a rigid body code;

generating a plurality of ball launch parameters from the rigid body code;

providing a plurality of first atmospheric conditions;

providing a plurality of lift and drag properties for the first golf ball;

inputting the plurality of ball launch parameters, the plurality of first atmospheric conditions and the plurality of lift and drag properties into a trajectory code; and generating a predicted performance from the trajectory code of the first golf ball if struck with the first golf club by the golfer under the first atmospheric conditions.

2. The method according to claim 1 wherein predicting the performance comprises predicting the trajectory shape, the trajectory apex, the dispersion of the golf ball, the flight distance of the golf ball and the roll distance of the golf ball.

3. The method according to claim 1 wherein the plurality of golf club head properties comprises the mass of the first golf club head, the location of the center of gravity of the first golf club head relative to the impact location of the first golf ball, the inertia tensor of the first golf club head, the geometry of the face of the first golf club head, the bulge and roll radii of the face of the first golf club head, the loft of the first golf club head and the face center location of the first golf club head.

4. The method according to claim 3 wherein the plurality of golf club head properties further comprises the coefficient of restitution of the first golf club head when striking the first golf ball, and a spin coefficient of restitution of the first golf club head when striking the first golf ball.

5. The method according to claim 1 wherein the plurality of golf ball properties comprises the mass of the first golf ball, the moment of inertia of the first golf ball and the radius of the first golf ball.

6. The method according to claim 5 wherein the plurality of golf ball properties further comprises the coefficient of restitution of the first golf ball at a speed of 143 feet per second.

7. The method according to claim 1 wherein the plurality of atmospheric conditions comprises the temperature, the pressure, the density of the air, the viscosity of the air, the relative humidity and the wind velocity.

8. The method according to claim 1 wherein the plurality of pre-impact properties comprises the impact location, the motion of the golf club head and the orientation of the golf club head.

9. The method according to claim 8 wherein the motion of the golf club head is provided as a three-orthogonal axes representation of velocity.

10. The method according to claim 8 wherein the motion of the golf club head is provided as speed and a directional vector represented by an elevation angle and an azimuth angle.

11. The method according to claim 1 wherein the plurality of ball launch parameters generated comprises a ball velocity and a ball angular velocity.

12. The method according to claim 1 wherein the plurality of ball launch parameters generated comprises a launch angle of the golf ball, a side angle of the golf ball, a golf ball speed, a spin of the golf ball and a spin axis of the golf ball.

13. A method for predicting a golfer's ball striking performance with a multitude of different golf clubs and a multitude of different golf balls, the method comprising:

using a CMOS imaging system to determine a plurality of pre-impact swing properties for the golfer based on the golfer's swing with a first golf club, the CMOS imaging system having a sensor array with at least one megapixel in size, wherein the CMOS imaging system forms a region of interest operating at a frame rate of 1000 to 4000 frames per second prior to the golf club entering the field of view and then forms subsequent regions of interest as the golf club travels through the field of view;

inputting a plurality of mass properties of a first golf club, a plurality of mass properties of a first golf ball, and the plurality of pre-impact swing properties into a rigid body code, wherein the first golf club has a substantially square club head and a moment of inertia Izz ranging from 3500 g-cm$^2$ to 6000 g-cm$^2$;

generating a first plurality of ball launch parameters from the first rigid body code;

inputting the first plurality of ball launch parameters, a plurality of atmospheric conditions and a plurality of lift and drag properties for the first golf ball into a trajectory code;

generating the performance from the trajectory code of the first golf ball if struck by the golfer with the first golf club under the plurality of atmospheric conditions;

inputting a plurality of mass properties of a second golf club, the plurality of mass properties of the first golf ball, and the plurality of pre-impact swing properties into the rigid body code, wherein the second golf club has a traditional club head shape;

generating a second plurality of ball launch parameters from the rigid body code;

inputting the second plurality of ball launch parameters, the plurality of atmospheric conditions and the plurality of lift and drag properties for the first golf ball into the trajectory code;

generating the performance from the trajectory code of the first golf ball if struck by the golfer with the second golf club under the first atmospheric conditions;

inputting the plurality of mass properties of the first golf club, a plurality of mass properties of a second golf ball, and the plurality of pre-impact swing properties into the rigid body code;

generating a third plurality of ball launch parameters from the rigid body code;

inputting the third plurality of ball launch parameters, the plurality of atmospheric conditions and a plurality of lift and drag properties for the second golf ball into the trajectory code; and generating the performance from the trajectory code of the second golf ball if struck by the golfer with the first golf club under the atmospheric conditions.

14. The method according to claim 13 wherein the first golf ball is a two-piece golf ball and the second golf ball is a three-piece solid golf ball.

15. The method according to claim 13 wherein the first golf club is a driver with a golf club head composed of a multiple materials and the second golf club is a driver with a golf club head composed of a cast stainless steel alloy.

16. A method for predicting a golfer's ball striking performance, the method comprising:

using a CMOS imaging system to determine a plurality of pre-impact swing properties for the golfer based on the golfer's swing with a first golf club, the CMOS imaging system having a sensor array with at least one megapixel in size, wherein the CMOS imaging system forms a region of interest operating at a frame rate of 1000 to 4000 frames per second prior to the golf club entering the field of view and then forms subsequent regions of interest as the golf club travels through the field of view;

inputting a plurality of mass properties of the first golf club, a plurality of mass properties of a first golf ball, and the plurality of pre-impact swing properties into a rigid body code;

generating a plurality of ball launch parameters from the rigid body code;

inputting the plurality of ball launch parameters into a trajectory code; and generating the trajectory shape, the trajectory apex, the dispersion of the golf ball, the flight distance of the golf ball and the roll distance of the first golf ball from the trajectory code if struck by the golfer with the first golf club under a first atmospheric conditions.

17. A method for predicting a golfer's ball striking performance, the method comprising:

using a CMOS imaging system to determine a plurality of pre-impact swing properties for the golfer based on the golfer's swing with a first golf club, wherein the plurality of pre-impact properties comprises an impact location, a motion of the golf club head and an orientation of the golf club head, the CMOS imaging system having a sensor array with at least one megapixel in size, wherein the CMOS imaging system forms a region of interest operating at a frame rate of 1000 to 4000 frames per second prior to the golf club entering the field of view and then forms subsequent regions of interest as the golf club travels through the field of view;

inputting a plurality of mass properties of the first golf club, a plurality of mass properties of a first golf ball, and the plurality of pre-impact swing properties into a rigid body code;

generating a plurality of ball launch parameters from the rigid body code;

providing a plurality of lift and drag properties for the first golf ball;

inputting the plurality of ball launch parameters and the plurality of lift and drag properties into a trajectory code; and generating the trajectory shape, the trajectory apex and the dispersion of the golf ball from the trajectory code if struck by the golfer with the first golf club under a first atmospheric conditions.

18. A method for predicting a golfer's ball striking performance, the method comprising:

using a CMOS imaging system to determine a plurality of pre-impact swing properties for the golfer based on the golfer's swing with a first golf club, wherein the plurality of pre-impact properties comprises an impact location, a motion of the golf club head and an orientation of the golf club head, the CMOS imaging system having a sensor array with at least one megapixel in size, wherein the CMOS imaging system forms a region of interest operating at a frame rate of 1000 to 4000 frames per second prior to the golf club entering the field of view and then forms subsequent regions of interest as the golf club travels through the field of view;

inputting a plurality of mass properties of the first golf club, a plurality of mass properties of a first golf ball, and the plurality of pre-impact swing properties into a rigid body code;

generating a plurality of ball launch parameters from the rigid body code, wherein the plurality of ball launch parameters generated comprises a launch angle of the golf ball, a side angle of the golf ball, a golf ball speed, a spin of the golf ball and a spin axis of the golf ball;

providing a plurality of first atmospheric conditions;

providing a plurality of lift and drag properties for the first golf ball;

inputting the plurality of ball launch parameters, the plurality of first atmospheric conditions and the plurality of lift and drag properties into a trajectory code; and generating the trajectory shape, the trajectory apex, the dispersion of the golf ball, the flight distance of the golf ball and the roll distance of the first golf ball from the trajectory code if struck by the golfer with the first golf club under the first atmospheric conditions.

* * * * *